US012692582B2

(12) United States Patent
Fukuchi et al.

(10) Patent No.: US 12,692,582 B2
(45) **Date of Patent: *Jul. 28, 2026**

(54) NON-ORIENTED ELECTRICAL STEEL SHEET, CORE, COLD-ROLLED STEEL SHEET, METHOD FOR MANUFACTURING NON-ORIENTED ELECTRICAL STEEL SHEET, AND METHOD FOR MANUFACTURING COLD-ROLLED STEEL SHEET

(71) Applicant: NIPPON STEEL CORPORATION, Tokyo (JP)

(72) Inventors: Minako Fukuchi, Tokyo (JP); Ichiro Tanaka, Tokyo (JP); Miho Tomita, Tokyo (JP); Tesshu Murakawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 783 days.

This patent is subject to a terminal disclaimer.

(21) Appl. No.: 17/911,105

(22) PCT Filed: Mar. 24, 2021

(86) PCT No.: PCT/JP2021/012270

§ 371 (c)(1),
(2) Date: Sep. 12, 2022

(87) PCT Pub. No.: WO2021/205880

PCT Pub. Date: Oct. 14, 2021

(65) Prior Publication Data

US 2023/0106818 A1 Apr. 6, 2023

(30) Foreign Application Priority Data

Apr. 10, 2020 (JP) ..... 2020-070883

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/10*** | (2006.01) |
| ***C22C 38/16*** | (2006.01) |
| ***C22C 38/60*** | (2006.01) |

(52) U.S. Cl.

CPC ..... *C22C 38/004* (2013.01); *C22C 38/001* (2013.01); *C22C 38/002* (2013.01); *C22C 38/008* (2013.01); *C22C 38/02* (2013.01); *C22C 38/06* (2013.01); *C22C 38/10* (2013.01); *C22C 38/16* (2013.01); *C22C 38/60* (2013.01)

(58) Field of Classification Search

CPC ... C22C 38/001; C22C 38/002; C22C 38/004; C22C 38/008; C22C 38/02; C22C 38/06; C22C 38/10; C22C 38/16; C22C 38/60

See application file for complete search history.

(56) References Cited

U.S. PATENT DOCUMENTS

| | | | |
|---|---|---|---|
| 2019/0017138 | A1 | 1/2019 | Uesaka et al. |
| 2021/0301363 | A1 | 9/2021 | Yashiki et al. |
| 2023/0106818 | A1 | 4/2023 | Fukuchi et al. |

FOREIGN PATENT DOCUMENTS

| | | | |
|---|---|---|---|
| CN | 108463569 | A | 8/2018 |
| CN | 112513299 | A | 3/2021 |
| JP | 2006-219692 | A | 8/2006 |
| JP | 4218077 | B2 | 2/2009 |
| JP | 2011-111658 | A | 6/2011 |
| JP | 2011-162821 | A | 8/2011 |
| JP | 5256916 | B2 | 8/2013 |
| JP | 2017-145462 | A | 8/2017 |
| JP | 2017-193731 | A | 10/2017 |
| JP | 2019-178380 | A | 10/2019 |
| JP | 2019-183185 | A | 10/2019 |
| JP | 2020-76138 | A | 5/2020 |
| JP | 6794630 | B2 | 12/2020 |
| WO | WO 2013/080891 | A1 | 6/2013 |
| WO | WO 2021/205880 | A1 | 10/2021 |

OTHER PUBLICATIONS

JP 2006-219692 machine translation of the description (Year: 2006).*

Randle, Valerie, Application of Microtexture Measurements in the SEM to Grain Boundary Parameters, Texture, Stress, and Microstructure, 20, 894127, 12 pages. https://doi.org/10.1155/TSM.20.231 (Year: 1993).*

JP 2006-219692 A. Partial translation of the description. (Year: 2006).*

* cited by examiner

*Primary Examiner* — Tima M. Mcguthry-Banks

(74) *Attorney, Agent, or Firm* — Birch, Stewart, Kolasch & Birch, LLP

(57) ABSTRACT

A non-oriented electrical steel sheet has a predetermined chemical composition. The chemical composition satisfies $(2\times[Mn]+2.5\times[Ni]+[Cu])-([Si]+2\times[sol.Al]+4\times[P])\geq 1.50\%$. In a case where Ahkl-uvw represents the area ratio of crystal grains in an {hkl}<uvw> orientation to the entire visual field when a plane at a depth of ½ of a sheet thickness from a surface parallel to a rolled surface is measured by SEM-EBSD, A411-011 is 15.0% or more, and the average grain size is 50 μm to 150 μm.

15 Claims, No Drawings

NON-ORIENTED ELECTRICAL STEEL SHEET, CORE, COLD-ROLLED STEEL SHEET, METHOD FOR MANUFACTURING NON-ORIENTED ELECTRICAL STEEL SHEET, AND METHOD FOR MANUFACTURING COLD-ROLLED STEEL SHEET

TECHNICAL FIELD OF THE INVENTION

The present invention relates to a non-oriented electrical steel sheet, a core, a cold-rolled steel sheet, a method for manufacturing a non-oriented electrical steel sheet, and a method for manufacturing a cold-rolled steel sheet.

Priority is claimed on Japanese Patent Application No. 2020-070883, filed on Apr. 10, 2020, the content of which is incorporated herein by reference.

RELATED ART

Electrical steel sheets are used as a material for cores of an electric device. Examples of the electric device include a drive motor mounted in a vehicle or a motor for various compressors represented by an air conditioner or a refrigerator, and a power generator for household or industrial use. These electric devices require to have high energy efficiency, small size, and high output. Therefore, the electrical steel sheets used as a core of the electric device require to have low iron loss and high magnetic flux density. As a solution to obtain low iron loss and high magnetic flux density, texture control is used, and so far, a technology for developing a structure (α-fiber) that has an easy magnetization axis in a surface of the steel sheet, is advantageous for improving magnetic characteristics, and can relatively easily enhance accumulation by rolling in hot rolling and cold rolling, which are essential steps of manufacturing the steel sheet, has been proposed. Specifically, a structure whose <110> direction is substantially parallel to a rolling direction (RD) is formed.

Patent Documents 1 to 3 all disclose a method for developing a {100}<011> orientation, in which a structure is refined by lowering a transformation temperature and rapidly cooling the structure after hot rolling.

Specifically, Patent Document 1 discloses that cooling to 250° C. or lower at a cooling rate of 200° C./sec or longer within 3 seconds after hot rolling is performed, annealing is not performed between the hot rolling and the cold rolling, and a cumulative rolling reduction in the cold rolling is set to 88% or more. As a result, it is possible to manufacture an electrical steel sheet that is accumulated on a surface of the steel sheet in the {100}<011> orientation.

Further. Patent Document 2 discloses a method for manufacturing an electrical steel sheet containing Al of 0.6 mass % or more and 3.0 mass % or less, in which an electrical steel sheet that {100}<011> orientation is accumulated on a surface of the steel sheet can be manufactured by the same method as that in Patent Document 1.

On the other hand, Patent Document 3 discloses that cooling is performed to a steel sheet temperature of 250° C. within 3 seconds after hot rolling while setting a finish rolling temperature to an Ac3 transformation point or higher in hot rolling, or cooling is performed at a cooling rate equal to or more than that the steel sheet is allowed to cool, while setting the finish rolling temperature to the Ac3 transformation point of −50° C. or lower in the hot rolling. In addition, in the manufacturing method described in Patent Document 3, first and second cold rolling are performed while performing an intermediate annealing therebetween, the annealing is not performed between the hot rolling and the first cold rolling, and a cumulative rolling reduction in the second cold rolling is set to 5% to 15%. As a result, it is possible to manufacture an electrical steel sheet that is accumulated on a surface of the steel sheet in the {100}<011> orientation.

In any of the methods described in Patent Documents 1 to 3, when the finish rolling temperature in the hot rolling is an Ac3 temperature or higher at the time of manufacturing the electrical steel sheet that is accumulated on the surface of the steel sheet in the {100}<011> orientation, rapid cooling immediately thereafter is required. When the rapid cooling is performed, a cooling load after the hot rolling increases. It is preferable that the load on a rolling mill that performs cold rolling is suppressed in consideration of operational stability.

On the other hand, in order to improve the magnetic characteristics, a technology for developing a {411} orientation rotated by 20° from a {100} orientation has also been proposed. Patent Documents 4 to 7 all disclose a technology for developing a {411} orientation, in which the grain size of a hot-rolled sheet is optimized or an α-fiber in a texture of the hot-rolled sheet is developed.

Specifically, Patent Document 4 describes that cold rolling is performed on the hot-rolled sheet having a relatively higher accumulation degree of a {211} orientation than an accumulation degree of the {411} orientation, and a cumulative rolling reduction in the cold rolling is set to 80% or more. Patent Document 4 also describes that as a result, it is possible to manufacture an electrical steel sheet that is accumulated on a surface of the steel sheet in the {411} orientation.

Further, Patent Documents 5 and 6 disclose that a slab heating temperature is set to 700° C. or higher and 1,150° C. or lower, a start temperature of finish rolling is set to 650° C. or higher and 850° C. or lower, a finishing temperature of finish rolling is set to 550° C. or higher and 800° C. or lower, and a cumulative rolling reduction in the cold rolling is set to 85% to 95%. Patent Documents 5 and 6 also disclose that as a result, it is possible to manufacture an electrical steel sheet that is accumulated on the surface of the steel sheet in the {100} orientation or the {411} orientation.

On the other hand, Patent Document 7 discloses a method for manufacturing a non-oriented electrical steel sheet, in which when an α-fiber is developed in a steel sheet of a hot-rolled coil to the vicinity of a surface layer of the steel sheet by strip casting or the like, a {h11}<1/h12> orientation, particularly, {100}<012> to {411}<148> orientations are recrystallized by subsequent annealing of the hot-rolled sheet.

PRIOR ART DOCUMENT

Patent Document

[Patent Document 1] Japanese Unexamined Patent Application, First Publication No. 2017-145462

[Patent Document 2] Japanese Unexamined Patent Application, First Publication No. 2017-193731

[Patent Document 3] Japanese Unexamined Patent Application, First Publication No. 2019-178380

[Patent Document 4] Japanese Patent No. 4218077

[Patent Document 5] Japanese Patent No. 5256916

[Patent Document 6] Japanese Unexamined Patent Application. First Publication No. 2011-111658

[Patent Document 7] Japanese Unexamined Patent Application, First Publication No. 2019-183185

SUMMARY OF THE INVENTION

Problems to be Solved by the Invention

As a result of studying the above technologies, the present inventors found that in order to develop the {100}<011> orientation and improve magnetic characteristics in accordance with Patent Documents 1 to 3, rapid cooling immediately after the hot rolling is required, and a problem of an increased manufacturing load occurs. Furthermore, the present inventors recognized that when a steel sheet having the developed {100}<011> orientation is used as a material for an interlocking core, core characteristics expected from the material may not be obtained. As result of studying, it is considable that a cause thereof is because the {100}<011> orientation has a large change in magnetic characteristics with respect to a stress, specifically, large deterioration of magnetic characteristics (stress sensitivity) when a compressive stress is applied.

Further, the present inventors found that although the {411} orientation is developed by the technologies in accordance with Patent Documents 4 to 7, the accumulation in the <011> orientation of an in-plane orientation is weak, and the magnetic characteristics in a 45° direction from a rolling direction of the steel sheet, which are characteristics of the α-fiber, are not sufficiently improved. The in-plane orientation that is not aligned in the <011> orientation, that is, having large deviation from the α-fiber is a factor that inhibits the accumulation in the {411} orientation as a plane orientation, which may be a cause that the magnetic characteristics are not sufficiently improved.

In view of the above problems, on the premise of the manufacturing method in which the manufacturing load is not increased, an object of the present invention is to provide a non-oriented electrical steel sheet capable of obtaining excellent stress sensitivity and excellent magnetic characteristics in a 45° direction, a core using the same, a cold-rolled steel sheet for manufacturing the non-oriented electrical steel sheet, a method for manufacturing a non-oriented electrical steel sheet, and a method for manufacturing a cold-rolled steel sheet.

Means for Solving the Problem

The present inventors have intensively studied to solve the above problems. As a result, the present inventors found that it is important to control a chemical composition, a ratio of crystal grains in a {411}<011> orientation on a plane parallel to a rolled surface, and an average grain size. In addition, the present inventors found that when controlling the chemical composition, the ratio of crystal grains, and the average grain size, it is important to optimize the grain size after hot rolling and the rolling reduction in cold rolling. Specifically, on the premise of the chemical composition of an α-γ transformation system, the present inventors found that it is important to easily develop the crystal grains in the {411}<011> orientation, which is normally difficult to develop, by cooling the steel sheet after the hot rolling under a predetermined condition to optimize the grain size, cold-rolling the steel sheet at a predetermined rolling reduction, controlling a temperature of the intermediate annealing within a predetermined range, and performing the annealing after performing second cold rolling at an appropriate rolling reduction. As a result of further intensive studies based on such findings, the present inventors came up with various aspects of the invention shown below.

[1] According to an aspect of the present invention, a non-oriented electrical steel sheet includes, as a chemical composition, by mass %: C: 0.0100% or less; Si: 1.50% to 4.00%; sol.Al: 0.0001% to 1.00%; S: 0.0100% or less: N: 0.0100% or less; one or more selected from the group consisting of Mn, Ni, and Cu: 2.5% to 5.0% in total; Co: 0% to 1.0%; Sn: 0% to 0.40%; Sb: 0% to 0.40%; P: 0% to 0.400%; one or more selected from the group consisting of Mg, Ca, Sr, Ba, Ce, La, Nd, Pr, Zn, and Cd: 0% to 0.010% in total; and a remainder of Fe and impurities, in which the following Equation (1) is satisfied, where, by mass %, a Mn content is [Mn], a Ni content is [Ni], a Cu content is [Cu], a Si content is [Si], a sol.Al content is [sol.Al], and a P content is [P], in a case where Ahkl-uvw represents an area ratio of crystal grains in an {hkl}<uvw> orientation to an entire visual field when a plane at a depth of ½ of a sheet thickness from a surface parallel to a rolled surface is measured by SEM-EBSD, A411-011 is 15.0% or more, and the average grain size is 50 μm to 150 μm.

$$(2\times[Mn]+2.5\times[Ni]+[Cu])-([Si]+2\times[sol.Al]+4\times[P]) \geq 1.50\% \quad (1)$$

[2] In the non-oriented electrical steel sheet to [1], when the surface is measured by the SEM-EBSD to create an ODF at φ2=45°, the non-oriented electrical steel sheet may have a maximum intensity at φ1=0° to 100 among φ1=0° to 90° and Φ=20°, and may have a maximum intensity at Φ=5° to 35° among φ1=0° and Φ=0° to 90°.

[3] In the non-oriented electrical steel sheet to [1] or [2], an area ratio of a specific orientation to the entire visual field when the plane at the depth of ½ of the sheet thickness from the surface parallel to the rolled surface is measured by the SEM-EBSD may satisfy both the following Equations (2) and (3).

$$A411-011 / A411-148 \geq 1.1 \quad (2)$$

$$A411-011 / A100-011 \geq 2.0 \quad (3)$$

[4] According to another aspect of the present invention, a non-oriented electrical steel sheet includes, as a chemical composition, by mass %: C: 0.0100% or less; Si: 1.50% to 4.00%; sol.Al: 0.0001% to 1.00%; S: 0.0100% or less; N: 0.0100% or less; one or more selected from the group consisting of Mn, Ni, and Cu: 2.5% to 5.0% in total; Co: 0% to 1.0%; Sn: 0% to 0.40%; Sb: 0% to 0.40%; P: 0% to 0.400%; one or more selected from the group consisting of Mg. Ca, Sr, Ba, Ce, La, Nd, Pr, Zn, and Cd: 0% to 0.010% in total; and a remainder of Fe and impurities, in which the following Equation (1) is satisfied, where, by mass %, a Mn content is [Mn], a Ni content is [Ni], a Cu content is [Cu], a Si content is [Si], a sol.Al content is [sol.Al], and a P content is [P], an area ratio $A_{s\alpha}$ of crystal grains having a crystal orientation of an α-fiber to an entire visual field when a plane at a depth of ½ of a sheet thickness from a surface parallel to a rolled surface is measured by SEM-EBSD is 20.0% or more, an ODF intensity in a {100}<011> orientation when the surface is measured by the SEM-EBSD to create an ODF is 15.0 or less, and when Gs is set as a number average value of GOS with respect to the entire visual field when the surface is measured by the SEM-EBSD, the Gs is 0.8 or more and 3.0 or less.

$$(2\times[Mn]+2.5\times[Ni]+[Cu])-([Si]+2\times[sol.Al]+4\times[P])\geq 1.50\% \quad (1)$$

[5] According to still another aspect of the present invention, a core includes the non-oriented electrical steel sheet according to anyone of [1] to [3].

[6] According to still another aspect of the present invention, a core includes the non-oriented electrical steel sheet according to [4].

[7] According to still another aspect of the present invention, a cold-rolled steel sheet which is used for manufacturing the non-oriented electrical steel sheet according to any one of [1] to [4], includes, as a chemical composition, by mass %: C: 0.0100% or less; Si: 1.50% to 4.00%; sol.Al: 0.0001% to 1.00%; S: 0.0100% or less; N: 0.0100% or less; one or more selected from the group consisting of Mn, Ni, and Cu: 2.5% to 5.0% in total; Co: 0% to 1.0%; Sn: 0% to 0.40%; Sb: 0% to 0.40%; P: 0% to 0.400%; one or more selected from the group consisting of Mg, Ca, Sr. Ba, Ce, La, Nd, Pr, Zn, and Cd: 0% to 0.010% in total; and a remainder of Fe and impurities, in which the following Equation (1) is satisfied, where, by mass %, a Mn content is [Mn], a Ni content is [Ni], a Cu content is [Cu], a Si content is [Si], a sol.Al content is [sol.Al], and a P content is [P], and an area ratio $A_{\alpha\alpha}$ of crystal grains having a crystal orientation of an α-fiber to an entire visual field when a plane at a depth of ½ of a sheet thickness from a surface parallel to a rolled surface is measured by SEM-EBSD is 15.0% or more.

$$(2\times[Mn]+2.5\times[Ni]+[Cu])-([Si]+2\times[sol.Al]+4\times[P])\geq 1.50\% \quad (1)$$

[8] According to still another aspect of the present invention, a method for manufacturing a non-oriented electrical steel sheet includes: a hot rolling step of performing hot rolling on a steel material so that a final pass of finish rolling is performed at an Ar3 temperature or higher to obtain a hot-rolled steel sheet, the steel material including, as a chemical composition, by mass %: C: 0.0100% or less, Si: 1.50% to 4.00%, sol.Al: 0.0001% to 1.00%, S: 0.0100% or less, N: 0.0100% or less, one or more selected from the group consisting of Mn, Ni, and Cu: 2.5% to 5.0% in total, Co: 0% to 1.0%, Sn: 0% to 0.40%, Sb: 0% to 0.40%. P: 0% to 0.400%, one or more selected from the group consisting of Mg, Ca. Sr. Ba, Ce, La, Nd, Pr, Zn, and Cd: 0% to 0.010% in total, and a remainder of Fe and impurities, in which the following Equation (1), where, by mass %, a Mn content is [Mn], a Ni content is [Ni], a Cu content is [Cu], a Si content is [Si], a sol.Al content is [sol.Al], and a P content is [P]; a cooling step of cooling the hot-rolled steel sheet after the hot rolling step; a cold rolling step of performing cold rolling on the hot-rolled steel sheet after the cooling step to obtain a cold-rolled steel sheet; an intermediate annealing step of performing intermediate annealing on the cold-rolled steel sheet; a skin pass rolling step of performing skin pass rolling on the cold-rolled steel sheet after the intermediate annealing step to obtain the non-oriented electrical steel sheet; and a final annealing step of performing final annealing on the non-oriented electrical steel sheet after the skin pass rolling step at an annealing temperature of 750° C. or higher and an Ac1 temperature or lower and at an annealing time of 2 hours or longer, in which in the cooling step, the cooling is started after 0.10 seconds or longer have elapsed from the final pass of the finish rolling, a temperature is set to 300° C. or higher and an Ar1 temperature or lower for transformation after 3 seconds, and a rolling reduction in the skin pass rolling step is 5% to 20%.

$$(2\times[Mn]+2.5\times[Ni]+[Cu])-([Si]+2\times[sol.Al]+4\times[P])\geq 1.50\% \quad (1)$$

[9] According to still another aspect of the present invention, a method for manufacturing a non-oriented electrical steel sheet includes: a hot rolling step of performing hot rolling on a steel material so that a final pass of finish rolling is performed at an Ar3 temperature or higher to obtain a hot-rolled steel sheet, the steel material including, as a chemical composition, by mass %: C: 0.0100% or less, Si: 1.50% to 4.00%, sol.Al: 0.0001% to 1.00%, S: 0.0100% or less, N: 0.0100% or less, one or more selected from the group consisting of Mn, Ni, and Cu: 2.5% to 5.0% in total, Co: 0% to 1.0%, Sn: 0% to 0.40%, Sb: 0% to 0.40%, P: 0% to 0.400%, one or more selected from the group consisting of Mg, Ca, Sr, Ba, Ce, La, Nd, Pr, Zn, and Cd: 0% to 0.010% in total, and a remainder of Fe and impurities, in which the following Equation (1) is satisfied, where, by mass %, a Mn content is [Mn], a Ni content is [Ni], a Cu content is [Cu], a Si content is [Si], a sol.Al content is [sol.Al], and a P content is [P]; a cooling step of cooling the hot-rolled steel sheet after the hot rolling step; a cold rolling step of performing cold rolling on the hot-rolled steel sheet after the cooling step to obtain a cold-rolled steel sheet; an intermediate annealing step of performing intermediate annealing on the cold-rolled steel sheet; and a skin pass rolling step of performing skin pass rolling on the cold-rolled steel sheet after the intermediate annealing step to obtain the non-oriented electrical steel sheet, in which in the cooling step, the cooling is started after 0.10 seconds or longer have elapsed from the final pass of the finish rolling, a temperature is set to 300° C. or higher and an Ar1 temperature or lower for transformation after 3 seconds, and a rolling reduction in the skin pass rolling step is 5% to 20%.

$$(2\times[Mn]+2.5\times[Ni]+[Cu])-([Si]+2\times[sol.Al]+4\times[P])\geq 1.50\% \quad (1)$$

[10] In the method for manufacturing a non-oriented electrical steel sheet according to [8] or [9], in the cooling step, an average grain size of the hot-rolled steel sheet after the cooling step may be 3 to 10 μm.

[11] In the method for manufacturing a non-oriented electrical steel sheet to any one of [8] to [10], a rolling reduction in the cold rolling step may be 75% to 95%.

[12] In the method for manufacturing a non-oriented electrical steel sheet to any one of [8] to [11], in the intermediate annealing step, an annealing temperature may be set to the Ac1 temperature or lower.

[13] According to still another aspect of the present invention, a method for manufacturing a cold-rolled steel sheet includes: a hot rolling step of performing hot rolling on a steel material so that a final pass of finish rolling is performed at an Ar3 temperature or higher to obtain a hot-rolled steel sheet, the steel material including, as a chemical composition, by mass %: C: 0.0100% or less, Si: 1.50% to 4.00%, sol.Al: 0.0001% to 1.00%, S: 0.0100% or less, N: 0.0100% or less, one or more selected from the group consisting of Mn, Ni, and Cu: 2.5% to 5.0% in total, Co: 0% to 1.0%, Sn: 0% to 0.40%, Sb: 0% to 0.40%, P: 0% to 0.400%, one or more selected from the group consisting of Mg, Ca, Sr, Ba, Ce, La, Nd, Pr, Zn, and Cd: 0% to 0.010% in total, and a remainder of Fe and impurities, in which the following Equation (1) is satisfied, where, by mass %, a Mn content is [Mn], a Ni content is [Ni], a Cu content is [Cu], a Si content is [Si], a sol.Al content is [sol.Al], and a P content is [P]; a cooling step of cooling the hot-rolled steel sheet after the hot rolling step; a cold rolling step of performing cold rolling on the hot-rolled steel sheet after the cooling step to obtain a cold-rolled steel sheet; and an intermediate annealing step of performing intermediate annealing on the cold-rolled steel sheet, in which in the cooling step, the cooling is started after 0.10 seconds or longer have elapsed from the final pass of the finish rolling, a temperature is set to 300° C. or higher and an Ar1 temperature or lower for transformation after 3 seconds.

$$(2\times[\mathrm{Mn}]+2.5\times[\mathrm{Ni}]+[\mathrm{Cu}])-([\mathrm{Si}]+2\times[sol.\mathrm{Al}]+4\times[\mathrm{P}])\geq 1.50\% \quad (1)$$

[14] In the method for manufacturing a cold-rolled steel sheet according to [13], in the cooling step, an average grain size of the hot-rolled steel sheet after the cooling step may be 3 to 10 μm.

[15] In the method for manufacturing a cold-rolled steel sheet according to [13] or [14], a rolling reduction in the cold rolling step may be 75% to 95%.

[16] In the method for manufacturing a cold-rolled steel sheet according to any one of the above [13] to [15], in the intermediate annealing step, an annealing temperature may be set to an Ac temperature or lower.

Effects of the Invention

According to the above aspects of the present invention, it is possible to provide a non-oriented electrical steel sheet capable of obtaining excellent stress sensitivity and excellent magnetic characteristics in a 450 direction, a core using the same, a cold-rolled steel sheet for manufacturing the non-oriented electrical steel sheet, a method for manufacturing a non-oriented electrical steel sheet, and a method for manufacturing a cold-rolled steel sheet.

EMBODIMENTS OF THE INVENTION

According to an embodiment of the present invention, a non-oriented electrical steel sheet (non-oriented electrical steel sheet according to the present embodiment), a core (core according to the present embodiment), a cold-rolled steel sheet (cold-rolled steel sheet according to the present embodiment), and manufacturing methods thereof will be described hereinafter in detail.

First, a chemical composition of a steel material (which serves as a material) used in the non-oriented electrical steel sheet according to the present embodiment and manufacturing the same will be described. In the following description, "%", which is a unit of a content of each element contained in the non-oriented electrical steel sheet or steel material, means "mass %" unless otherwise specified. In addition, a numerical range represented by using "to" means a range including numerical values before and after "to" as a lower limit and an upper limit.

According to the present embodiment, a non-oriented electrical steel sheet and a cold-rolled steel sheet have a chemical composition in which a ferrite-austenite transformation (hereinafter referred to as α-γ transformation) can occur to some extent (chemical composition in which a constant amount of γ is generated when heated, even if the entire composition is not transformed into γ), the chemical composition containing, by mass %: C: 0.0100% or less; Si: 1.50% to 4.00%; sol.Al: 0.0001% to 1.00%; S: 0.0100% or less; N: 0.0100% or less; one or more selected from the group consisting of Mn, Ni, and Cu: 2.5% to 5.0% in total; Co: 0% to 1.0%; Sn: 0% to 0.40%; Sb: 0% to OA %; P: 0% to 0.400%; one or more selected from the group consisting of Mg, Ca, Sr. Ba, Ce, La, Nd, Pr, Zn, and Cd: 0% to 0.010% in total; and a remainder of Fe and impurities. Furthermore, contents of Mn, Ni, Cu, Si, sol.Al, and P satisfy predetermined conditions to be described below. Examples of impurities include those contained in a raw material such as ore or scrap, and those contained in a manufacturing process.

(C: 0.0100% or Less)

C is an element that increases iron loss and causes magnetic aging due to precipitation of fine carbides and inhibition of grain growth. Therefore, the lower C content is more desirable. Such a phenomenon is remarkable when the C content exceeds 0.0100%. Therefore, the C content is set to 0.0100% or less. The C content is preferably 0.0050% or less, and more preferably 0.0025% or less. The lower limit of the C content is not particularly limited, but the C content is preferably 0.0005% or more in consideration of costs of a decarburization treatment in refining.

(Si: 1.50% to 4.00%)

Si is an element that reduces iron loss by increasing an electric resistance and reducing the eddy-current loss, and improves punching workability to an iron core by increasing a yield ratio. If the Si content is less than 1.50%, these effects cannot be sufficiently obtained. Therefore, the Si content is set to 1.50% or more.

On the other hand, when the Si content exceeds 4.00%, a magnetic flux density is reduced, the punching workability is deteriorated due to an excessive increase in hardness, and cold rolling is hardly performed. Therefore, the Si content is set to 4.00% or less.

(sol.Al: 0.0001% to 1.00%)

Sol.Al is an element that reduces iron loss by increasing the electric resistance and reducing the eddy-current loss. Sol.Al is an element that also contributes to the improvement in relative magnitude of a magnetic flux density B50 with respect to a saturation magnetic flux density. Here, the magnetic flux density B50 is a magnetic flux density in a magnetic field of 5000 Å/m. If the sol.Al content is less than 0.0001%, these effects cannot be sufficiently obtained. In addition. Al has a desulfurization-promoting effect in steelmaking. Therefore, the sol.Al content is 0.0001% or more.

On the other hand, if the sol.Al content exceeds 1.00%, the magnetic flux density is reduced. Therefore, sol.Al content is set to 1.00% or less.

(S: 0.0100% or Less)

S is not an essential element, and is contained, for example, as an impurity in steel. S is precipitated as fine MnS, and inhibits recrystallization and growth of crystal grains during annealing. Therefore, the lower S content is more desirable. The increase in iron loss and the reduction in magnetic flux density due to the inhibition of the recrystallization and the growth of crystal grains are remarkable when the S content exceeds 0.0100%. Therefore, the S content is set to 0.0100% or less. A lower limit of the S content is not particularly limited, but the S content is preferably 0.0003% or more in consideration of costs of a desulfurization treatment in refining.

(N: 0.0100% or Less)

N deteriorates magnetic characteristics through formation of fine precipitates such as TiN and AlN. Therefore, the lower N content is more desirable. Since such deterioration of the magnetic characteristics is remarkable when the N content exceeds 0.0100%, the N content is set to 0.0100% or less. The lower limit of the N content is not particularly limited, but the N content is preferably 0.0010% or more in consideration of costs of a denitrification treatment in refining.

(One or More Selected from the Group Consisting of Mn, Ni, and Cu: 2.5% to 5.0% in Total)

These elements are elements necessary for causing α-γ transformation, and thus, it is necessary to contain at least one of these elements in a total amount of 2.5% or more.

On the other hand, if the total content exceeds 5.0%, not only the cost may increase, but also the magnetic flux density may be reduced. Therefore, at least one of these elements is set to 5.0% or less in total.

Moreover, it is necessary to further satisfy the following conditions as conditions for causing the α-γ transformation and obtaining good magnetic characteristics. That is, when the Mn content (mass %) is [Mn], the Ni content (mass %) is [Ni], the Cu content (mass %) is [Cu], the Si content (mass %) is [Si], the sol.Al content (mass %) is [sol.Al], and the P content (mass %) is [P], the following Equation (1) is satisfied.

$$(2\times[\mathrm{Mn}]+2.5\times[\mathrm{Ni}]+[\mathrm{Cu}])-([\mathrm{Si}]+2\times[sol.\mathrm{Al}]+4\times[\mathrm{P}])\geq 1.50\% \quad (1)$$

When Equation (1) is not satisfied, the α-γ transformation does not occur, or even if the α-γ transformation occurs, a transformation point is high. Therefore, a sufficient magnetic flux density cannot be obtained even if a manufacturing method to be described later is applied.

(Co: 0% to 1.0%)

Co is an element that increases the magnetic flux density. Therefore, Co may be contained if necessary.

On the other hand, if Co is excessively contained, costs thereof becomes high. Therefore, the Co content is set to 1.0% or less.

(Sn: 0% to 0.40%, Sb: 0% to 0.40%)

Sn and Sb improve a texture after cold rolling and recrystallization to improve the magnetic flux density. Therefore, these elements may be contained if necessary. When further effects such as magnetic characteristics are imparted, it is preferable to contain at least one selected from the group consisting of Sn in an amount of 0.02% to 0.40% and Sb in an amount of 0.02% to 0.40%.

On the other hand, if these elements are excessively contained, the steel becomes brittle. Therefore, both the Sn content and the Sb content are set to 0.40% or less.

(P: 0% to 0.400%)

P is an effective element for ensuring hardness of the steel sheet after the recrystallization. P is also an element having a suitable effect on magnetic characteristics. Therefore, P may be contained. When these effects are obtained, the P content is preferably set to 0.020% or more.

On the other hand, if P is contained in excess, the steel becomes brittle. Therefore, the P content is set to 0.400% or less.

(One or More Selected from the Group Consisting of Mg, Ca. Sr, Ba, Ce, La, Nd, Pr, Zn, and Cd: 0% to 0.010% in Total)

Mg, Ca, Sr, Ba, Ce, La, Nd, Pr, Zn, and Cd react with S in a molten steel during casting of the molten steel and form precipitates of sulfide or oxysulfide, or both of them. Hereinafter, Mg, Ca, Sr, Ba, Ce, La, Nd, Pr, Zn, and Cd may be collectively referred to as "coarse precipitate forming elements". The grain size of the precipitate of the coarse precipitate forming element is about 1 μm to 2 μm, which is much larger than a grain size (about 100 nm) of a fine precipitate of MnS, TiN, AlN, or the like. Therefore, these fine precipitates adhere to the precipitate of the coarse precipitate forming element, which makes it difficult to inhibit the recrystallization and the growth of crystal grains during annealing such as intermediate annealing. In order to sufficiently obtain these effects, these elements are preferably 0.0005% or more in total. These elements are more preferably 0.001% or more.

On the other hand, if the content of these elements exceeds 0.010% in total, the total amount of the sulfide or the oxysulfide, or both of them is excessive, and the recrystallization and the growth of crystal grains are inhibited during annealing such as intermediate annealing. Therefore, the content of the coarse precipitate forming elements is set to 0.010% or less in total.

The chemical composition is obtained by the following method.

The chemical composition may be measured by a general method for analyzing steel. For example, the chemical composition may be measured using inductively coupled plasma-atomic emission spectrometry (ICP-AES). Specifically, the chemical composition is specified by measuring a test piece collected from the steel sheet with a predetermined measuring device under conditions based on a calibration curve prepared in advance. C and S may be measured using a combustion-infrared absorption method, and N may be measured using an inert gas fusion thermal conductivity detection method.

When the surface has an insulation coating, the insulation coating may be mechanically removed with a minitor or the like before the analysis.

Next, a texture of the non-oriented electrical steel sheet according to the present embodiment will be described.

First, a method for measuring an area ratio of specific oriented grains in the non-oriented electrical steel sheet according to the present embodiment will be described. The area ratio of specific oriented grains is measured with OIM Analysis 7.3 (manufactured by TSL) by extracting a target specific orientation (a tolerance is set to 10°, hereinafter referred to as a tolerance of within 10°) from a measurement region observed under the following measurement conditions by a scanning electron microscope (SEM) with electron back scattering diffraction (EBSD). The area of the extracted specific orientation is divided by an area of the measurement region to obtain a percentage. This percentage is defined as the area ratio of specific oriented grains. Hereinafter, an "area ratio of crystal grains having a crystal orientation in an {hkl}<uvw> orientation (tolerance of within 10°) to the measurement region" and an "area ratio of crystal grains having a crystal orientation in an {hkl} orientation (within a tolerance of 10° to the measurement region" may be referred to as a "{hkl}<uvw> ratio" and a "{hkl} ratio", respectively. Hereinafter, in the description of the crystal orientation, it is assumed that the tolerance is within 10°.

The details of the measurement conditions for obtaining the area ratio of each orientation grain are as follows.

- Measuring device: SEM model number "JSM-6400 (manufactured by JEOL Ltd.)" and EBSD detector model number "HIKARI (manufactured by TSL)" are used
- Step interval: 0.3 μm (after intermediate annealing, after skin pass rolling) or 5.0 μm (after final annealing)
- Magnification: 1000 times (after intermediate annealing, after skin pass rolling) or 100 times (after final annealing)
- Measurement target: plane parallel to a rolled surface at a depth of ½ of a sheet thickness from the surface
- Measurement region: rectangular region of 1,000 μm or more×1.000 μm or more In the non-oriented electrical steel sheet according to the present embodiment, when the surface (the same applies to a steel sheet surface except for the insulation coating, when the surface has the insulation coating) is measured by a scanning electron microscope with electron back scattering diffraction (SEM-EBSD) in the manner described above, a {411}<011> ratio (A411-011, when Ahkl-uvw represents the area ratio of crystal grains in the {hkl}<uvw> orientation (within a tolerance of 10°) to the entire visual field) is set to 15.0% or more. If the {411}<011> ratio is less than 15.0%, excellent magnetic characteristics cannot be obtained. Therefore, the {411}<011> ratio is 15.0% or more, preferably 25.0% or more. The upper limit thereof is not particularly limited.

Moreover, when the surface is measured by the SEM-EBSD, the non-oriented electrical steel sheet according to the present embodiment preferably has a maximum intensity at φ1=0° to 10° among φ1=0° to 90° and Φ=20°, and the maximum intensity at Φ=5° to 35° among φ1=0° and Φ=0° to 90°.

Having the maximum intensity at φ1=0° to 10° among φ1=0° to 9° and Φ=20° is synonymous with having the maximum intensity near the {411}<011> orientation among the {411}<uvw> orientations. The {411}<011> orientation has excellent magnetic characteristics in a 45° direction as compared to the other orientation among the {411}<uvw> orientations such as {411}<148> orientation. It is more preferable to have a maximum intensity at φ1=0° to 5° among φ1=0° to 90° and Φ=20°.

On the other hand, having the maximum intensity at Φ=5° to 35° among φ1=0° and Φ=0° to 90° when the surface is measured by the SEM-EBSD is synonymous with having the maximum intensity near the {411}<011> orientation among the {hkl}<011> orientations. Since the {411}<011> orientation has excellent magnetic characteristics and lower stress sensitivity than the {100}<011> orientation, there is little magnetic deterioration in an interlocking core or the like. It is more preferable to have the maximum intensity at Φ=20° to 30° among φ1=0° and Φ=0 to 90°.

A method for determining the maximum intensity in a specific orientation range and an intensity in a specific orientation (ODF intensity) of the steel sheet will be described. In the measurement region by the SEM-EBSD, an orientation distribution function (ODF) is created under the following conditions using OIM Analysis 7.3. Then, the created ODF data is output, and a point having the maximum ODF value within the specific orientation range (defining a range by angles of φ1 and Φ) is set as a maximum intensity. In addition, the ODF value of a specific orientation (defining an orientation by angles of φ1 and Φ) is set as an ODF intensity of the corresponding orientation.

The details of ODF creation conditions are as follows.

Series Rank [L]: 16

Gaussian Half-Width [degrees]: 5

Sample Symmetry: Triclinic (None)

Bunge Euler Angles: φ1=0° to 90°, φ2=45°, Φ=0° to 90°

Moreover, in the non-oriented electrical steel sheet according to the present embodiment, the area ratio of crystal grains having a specific orientation (within a tolerance of 10°) to the entire visual field when the surface is measured by SEM-EBSD is represented as follows. When an area ratio of crystal grains having a crystal orientation in the {hkl}<uvw> orientation (within a tolerance of 10°) to the entire visual field is represented by Ahkl-uvw, and an area ratio of crystal grains having a crystal orientation in the {hkl} orientation (within a tolerance of 10°) to the entire visual field is represented by Ahkl, both of the following Equations (2) and (3) are preferably satisfied.

$$A411-011/A411-148 \geq 1.1 \quad (2)$$

$$A411-011/A100-011 \geq 2.0 \quad (3)$$

For Equation (2), the {411}<011> orientation has excellent magnetic characteristics in a 450 direction as compared to the other orientation among the {411}<uvw> orientations such as {411}<148> orientations. Thus, the {411}<011> ratio preferably exceeds a {411}<148> ratio, and more preferably a {411}<011> ratio that is 1.1 times or more the {411}<011> ratio (a ratio of A411-011 to the A411-148 is 1.1 or more).

Further, for Equation (3), since the stress sensitivity of the magnetic characteristics in the {411}<011> orientation is lower than that in the {100}<011> orientation, the {411}<011> ratio preferably exceeds the {100}<011> ratio, and more preferably the {411}<011> ratio that is 2.0 times or more the {100}<011> ratio.

Next, an average grain size of the non-oriented electrical steel sheet according to the present embodiment will be described. If the average grain size is too small without coarsening the crystal grains, the iron loss is deteriorated. On the other hand, if the crystal grains are excessively coarsened and the average grain size is too large, not only the workability is deteriorated, but also the eddy-current loss is deteriorated. Therefore, the average grain size of the non-oriented electrical steel sheet is set to 50 μm to 150 μm. The grain size is measured by, for example, an intercept method of JIS G0551 (2020).

Next, a sheet thickness of the non-oriented electrical steel sheet according to the present embodiment will be described. The sheet thickness of the non-oriented electrical steel sheet according to the present embodiment is not particularly limited. A preferred sheet thickness of the non-oriented electrical steel sheet according to the present embodiment is 0.25 to 0.50 mm. Generally, when the sheet thickness is small, although the iron loss is lowered, the magnetic flux density is lowered. Considering this point, when the sheet thickness is 0.25 mm or more, the iron loss is lowered, and the magnetic flux density is increased. Further, when the sheet thickness is 0.50 mm or less, the low iron loss can be maintained. A more preferred lower limit of the sheet thickness is 0.30 mm.

The non-oriented electrical steel sheet described above has characteristics of a non-oriented electrical steel sheet manufactured by hot rolling, cooling, cold rolling, intermediate annealing, skin pass rolling, and final annealing, which will be described below.

Next, the characteristics of the non-oriented electrical steel sheet before final annealing (after skin pass rolling) will be described.

The non-oriented electrical steel sheet after skin pass rolling (before final annealing) according to the present embodiment has the following grain orientation spread (GOS) value. The GOS value is an average of an orientation difference between all measurement points (pixels) in the same grain, and the GOS value is high in the crystal grain with many strains. After skin pass rolling, if the GOS value is small, that is, in a low strain state, grain growth due to bulging easily occurs during final annealing of the next process. Thus, a number average value Gs of the GOS value after skin pass rolling is set to 3.0 or less.

On the other hand, if the number average value Gs of the GOS value is less than 0.8, a strain amount becomes too small, and a final annealing time required for the grain growth due to bulging becomes long.

Therefore, the number average value Gs of GOS values after skin pass rolling is set to 0.8 or more and 3.0 or less.

A calculation method of Gs will be described.

Analysis is performed with OIM Analysis 7.3 using SEM-EBSD data when the crystal orientation is defined, to obtain the number average value of the GOS value, which is set as Us.

Moreover, in the non-oriented electrical steel sheet after skin pass rolling (before final annealing), the larger the α-fiber ratio, the more favorable the magnetic characteristics after final annealing. Therefore, in the non-oriented electrical steel sheet after skin pass rolling (before final annealing) according to the present embodiment, the α-fiber ratio ($A_{s\alpha}$) is set to 20.0% or more. $A_{s\alpha}$ is preferably 25.0% or more.

In the present embodiment, the α-fiber is set as the {hkl}<011> orientation.

A method for measuring an α-fiber ratio will be described.

In the measurement region by the SEM-EBSD at a depth of ½ of the sheet thickness from the surface, the {hkl}<011> orientation is extracted (within a tolerance of 10°) using OIM Analysis 7.3. The area of the extracted specific orientation is divided by an area of the measurement region to obtain a percentage. This percentage is set as the α-fiber ratio.

Moreover, in the non-oriented electrical steel sheet after skin pass rolling (before final annealing) according to the present embodiment, the ODF intensity in the {100}<011> orientation is set to 15.0 or less. Here, the ODF intensity of the {100}<011> orientation is an ODF value of φ1=0° and Φ=0° which is created using the SEM-EBSD data when the crystal orientation is defined. Since the {411}<011> orientation has excellent magnetic characteristics and lower stress sensitivity than the {100}<011> orientation, there is little magnetic deterioration in an interlocking core or the like. By setting the ODF intensity in the {100}<011> orientation after skin pass rolling (before final annealing) to 15.0 or less, the {411}<011> orientation after subsequent final annealing can be developed.

The ODF intensity of a specific orientation including the {100}<011> orientation is obtained by the following method.

In the measurement region by the SEM-EBSD, an orientation distribution function (ODF) is created under the following conditions using OIM Analysis 7.3. Then, data of the created ODF is output, and the ODF value of a specific orientation (defining an orientation by angles of φ1 and Φ) is set as an ODF intensity of the corresponding orientation.

The non-oriented electrical steel sheet according to the present embodiment can be widely applied to applications in which magnetic characteristics (high magnetic flux density and iron loss) are required by forming a core. The applications of the core are as follows, for example.

(A) Servo motor, stepping motor, and compressor used in electric device (B) Drive motor used for electric vehicles and hybrid vehicles. Here, the vehicles include automobiles, motorcycles, railways, and the like.

(C) Generator (D) Iron core, choke coil, and reactors for various purposes (E) Current sensor, and the like The non-oriented electrical steel sheet according to the present embodiment can be applied to applications other than the above-described applications. The non-oriented electrical steel sheet according to the present embodiment is particularly suitable for use as a segmented core designed so that the 45° direction from the rolling direction of the steel sheet is a main magnetization direction of the core, and is suitable for a segmented core of the drive motor in electric vehicles or hybrid vehicles applied to a high-frequency range at 1,000 Hz or more.

Next, a cold-rolled steel sheet according to the present embodiment will be described.

The cold-rolled steel sheet according to the present embodiment is a cold-rolled steel sheet used for manufacturing the above-described non-oriented electrical steel sheet.

The chemical composition is not substantially changed when the non-oriented electrical steel sheet is manufactured from the cold-rolled steel sheet, and thus the chemical composition of the cold-rolled steel sheet according to the present embodiment is set to be in the same range as the above-described non-oriented electrical steel sheet according to the present embodiment.

Moreover, in the cold-rolled steel sheet according to the present embodiment, an area ratio $A_{s\alpha}$ of crystal grains having a crystal orientation of the α-fiber to the entire visual field when a plane parallel to a rolled surface at a depth ½ of a sheet thickness from the surface is measured by SEM-EBSD is 15.0% or more.

When $A_{s\alpha}$ is less than 15.0%, the α-fiber ratio ($A_{s\alpha}$) after light reduction cold rolling (skin pass rolling) does not become 20.0% or more, and the {411}<011> ratio after final annealing does not become 15.0% or more.

Next, a core according to the present embodiment will be described.

The core according to the present embodiment is a core formed by punching and stacking the non-oriented electrical steel sheet after skin pass rolling (before final annealing) according to the present embodiment described above (core including the non-oriented electrical steel sheet after skin pass rolling (before final annealing) according to the present embodiment). Alternatively, the core according to the present embodiment is a core formed with the non-oriented electrical steel sheet according to the present embodiment described above (core including the non-oriented electrical steel sheet according to the present embodiment).

Next, an example of a method for manufacturing the non-oriented electrical steel sheet according to the present embodiment will be described. The non-oriented electrical steel sheet according to the present embodiment is obtained by a manufacturing method including a hot rolling step, a cooling step, a cold rolling step, an intermediate annealing step, second cold rolling (a light reduction cold rolling step, hereinafter referred to as a skin pass rolling step), and a final annealing step.

In addition, the non-oriented electrical steel sheet (after skin pass rolling (before final annealing)) according to the present embodiment is obtained through the steps before the final annealing (the hot rolling step, the cooling step, the cold rolling step, the intermediate annealing step, and the skin pass rolling step).

Hereinafter, preferable conditions for each step will be described.

Hereinafter, in the present embodiment, the following methods are used to obtain an Ar3 temperature, an Ar1 temperature, and an Ac1 temperature (all having a unit of C).

The Ar3 temperature and the Ar1 temperature are obtained from change in thermal expansion of the steel material (steel sheet) during cooling at an average cooling rate of 1° C./sec, and the Ac temperature is obtained from change in thermal expansion of the steel material (steel sheet) during heating at an average heating rate of 1° C./sec.

(Hot Rolling Step)

In the hot rolling step, a hot-rolled steel sheet is manufactured by performing hot rolling on the steel material that satisfies the above-described chemical composition. The hot rolling step includes a heating process and a rolling process.

The steel material is, for example, a slab manufactured by ordinary continuous casting, and the steel material having the above-described composition is manufactured by a well-known method. For example, a molten steel is manufactured in a converter or an electric furnace. The manufactured molten steel is secondarily refined with a degassing facility or the like to obtain a molten steel having the above-described chemical composition (the chemical composition does not substantially change in the subsequent steps). The slab is cast using molten steel by a continuous casting method or an ingot-making method. The cast slab may be lump-rolled.

In the heating process, it is preferable to heat the steel material having the above-described chemical composition to 1,000° C. to 1,200° C. Specifically, the steel material is charged into a heating furnace or a soaking furnace, and heated in the furnace. A retention time at the above-described heating temperature in the heating furnace or the soaking furnace is not particularly limited, but is, for example, 30 to 200 hours.

In the rolling process, a plurality of passes of rolling are performed on the steel material heated by the heating process to manufacture a hot-rolled steel sheet. Here, the "pass" means that the steel sheet passes through one rolling stand having a pair of work rolls and is subjected to rolling. As the hot rolling, for example, the plurality of passes of rolling may be performed by performing tandem rolling using a tandem rolling mill including a plurality of rolling stands arranged in a row (each rolling stand has the pair of work rolls), and a plurality of passes of rolling may be performed by performing reverse rolling with a pair of work rolls. In terms of productivity, the rolling pass is preferably performed multiple times with the tandem rolling mill.

Rolling in the rolling process (rough rolling and finish rolling) is preferably performed at a temperature of a γ region (Ar3 temperature or higher). That is, the hot rolling is preferably performed so that a temperature when the steel sheet passes through the final pass of the finish rolling (finish rolling temperature FT (° C.)) is set to the Ar3 temperature or higher.

The finish rolling temperature FT means a surface temperature (° C.) of the steel sheet on an exit side of the rolling stand where the final pass of the rolling is performed in the rolling process during the hot rolling step. The finish rolling temperature FT can be measured with, for example, a thermometer installed on the exit side of the rolling stand where the final pass of the rolling is performed. The finish rolling temperature FT means an average value of temperature measurement results in the individual sections excluding the front end section and the rear end section, for example, in the case where the total length of the steel sheet is divided into 10 sections in the rolling direction.

(Cooling Step)

After the hot rolling step, the steel sheet (hot-rolled steel sheet) is cooled. By transformation from austenite to ferrite due to the cooling, high strain and moderately fine crystal grains are obtained. As cooling conditions, the cooling is started 0.10 seconds later after the steel sheet has passed through the final pass of the finish rolling (after 0.10 seconds or longer have elapsed), and the cooling is performed so that a surface temperature of the hot-rolled steel sheet after 3 seconds is set to 300° C. or higher and the Ar1 temperature or lower (so that rapid cooling immediately after is not performed). By avoiding the rapid cooling immediately after as described above, a special rapid cooling apparatus is not required, which is advantageous in manufacturing (costs). In addition, it is presumed that a texture of the hot-rolled steel sheet becomes a structure obtained by transforming unrecrystallized austenite when the rapid cooling immediately after is performed. Thereafter, the texture of the hot-rolled steel sheet is accumulated in the {100}<011> orientation of the structure after final annealing. On the other hand, a texture of the hot-rolled steel sheet becomes a structure obtained by transforming a partially recrystallized austenite in a case where the rapid cooling immediately after is not performed. Thereafter, the texture of the hot-rolled steel sheet is accumulated in the {411}<011> orientation of the structure after final annealing. Thus, in order to increase the {411}<011> ratio, it is important to consider the transform of the partially recrystallized austenite.

Moreover, as a cooling condition, a condition is preferably set so that the hot-rolled steel sheet before the cold rolling has an average grain size of 3 to 10 μm. When the cold rolling is then performed at a suitable grain size that does not allow excessive refinement, the α-fiber develops after intermediate annealing. In this case, after the subsequent skin pass and final annealing, the {411}<011> orientation which is normally difficult to develop can be developed. On the other hand, if the crystal grains are too coarse, the α-fiber is difficult to develop after the cold rolling and the intermediate annealing, a desired {411}<011> ratio may not be obtained. In order to set the average grain size of the hot-rolled steel sheet before the cold rolling to 3 to 10 μm, a temperature of the hot-rolled steel sheet may be set to a temperature of the Ar1 temperature or lower within 3 seconds after the steel sheet has passed through the final pass of the finish rolling.

If a cooling stop temperature is lower than 300° C., the average grain size of the hot-rolled steel sheet is excessively refined. Therefore, the cooling stop temperature is set to 300° C. or higher.

The temperature of the hot-rolled steel sheet (particularly, the finish rolling temperature) and the surface temperature of the hot-rolled steel sheet after 3 seconds after the steel sheet has passed through the final pass of the finish rolling are measured by the following method.

On a hot-rolling equipment line used for manufacturing an electrical steel sheet, a cooling apparatus and a transfer line (for example, a transfer roller) are disposed downstream of a hot-rolling mill. A thermometer that measures the surface temperature of the hot-rolled steel sheet is disposed on the exit side of the rolling stand performing the final pass of the hot-rolling mill. In addition, a plurality of thermometers are also arranged along the transfer line on the transfer roller disposed downstream of the rolling stand. Therefore, a hot rolling temperature and the surface temperature of the hot-rolled steel sheet after 3 seconds after the steel sheet has passed through the final pass of the finish rolling are measured with the thermometer disposed on the hot-rolling equipment line.

The cooling apparatus is disposed downstream of the rolling stand that performs the final pass. Generally, a plurality of water-cooling apparatus are disposed, and the thermometers are each disposed on an entrance side of the water-cooling apparatuses. The cooling apparatus may be, for example, a well-known water-cooling apparatus or a well-known forced air cooling apparatus. Preferably, the cooling apparatus is the water-cooling apparatus. The coolant of the water-cooling apparatus may be water or a mixed fluid of water and air.

Thereafter, the cold rolling is performed on the hot-rolled steel sheet without performing annealing on the hot-rolled steel sheet (hot-rolled sheet annealing).

(Cold Rolling Step)

The hot-rolled steel sheet is coiled without hot-rolled sheet annealing, and the cold rolling is performed on the hot-rolled sheet to obtain a cold-rolled steel sheet. The term "hot-rolled sheet annealing" as used herein means, for example, a heat treatment in which a rising temperature is the Ac1 temperature or lower and 300° C. or higher.

As the cold rolling, for example, the plurality of passes of rolling may be performed by performing tandem rolling using a tandem rolling mill including a plurality of rolling stands arranged in a row (each rolling stand has a pair of work rolls). In addition, one pass or the plurality of passes of rolling may be performed by performing reverse rolling with a Sendzimir rolling mill having a pair of work rolls. In terms of productivity, the plurality of passes of rolling is preferably performed using the tandem rolling mill.

In the cold rolling, cold rolling is performed without performing an annealing treatment in the middle of the cold rolling. For example, in a case where the reverse rolling is performed to perform the cold rolling in the plurality of passes, a plurality of passes of the cold rolling is performed without performing the annealing treatment between the passes of the cold rolling. If the annealing is performed between the passes, a desired orientation cannot be developed in a step to be described below.

As the cold rolling, cold rolling may be performed only one pass using a reverse-type rolling mill. In addition, in a case where the cold rolling is performed using a tandem-type rolling mill, the cold rolling is performed continuously in the plurality of passes (passes of respective rolling stands).

In the present embodiment, a rolling reduction RR1(%) in the cold rolling is preferably 75% to 95%. Here, the rolling reduction RR1 is defined as follows.

Rolling reduction RR1(%)=(1−sheet thickness after plurality of final passes of rolling in cold rolling/sheet thickness before first pass of rolling in cold rolling)×100

(Intermediate Annealing Step)

If the cold rolling is completed, intermediate annealing is subsequently performed. In the present embodiment, it is preferable to control an annealing temperature (intermediate annealing temperature T1) (° C.) to the Ac1 temperature or lower. If a temperature of the intermediate annealing exceeds the Ac1 temperature, a part of the structure in the steel sheet is transformed into austenite. Due to change in crystal orientation according to the transformation, the magnetic flux density may not be increased without sufficiently growing grains in the {411}<011> orientation upon the subsequent skin pass rolling and final annealing.

On the other hand, if the temperature of the intermediate annealing is too low, recrystallization does not occur, and the magnetic flux density may not be increased without sufficiently growing the grains in the {411}<011> orientation upon the subsequent skin pass rolling and final annealing. Therefore, the intermediate annealing temperature T1 (° C.) is preferably 600° C. or higher.

The intermediate annealing temperature T1 (° C.) is a sheet temperature (surface temperature) near an extraction port of the annealing furnace.

The retention time at the intermediate annealing temperature T1 (° C.) in the intermediate annealing step may be a time that is well known to those skilled in the art. The retention time at the intermediate annealing temperature T1 (° C.) is, for example, 5 to 60 seconds, but is not limited thereto. Further, a temperature rising rate up to the intermediate annealing temperature T1 (° C.) may be a well-known condition. The temperature rising rate up to the intermediate annealing temperature T1 (° C.) is, for example, 10.0 to 20.0° C./sec, but is not limited thereto.

The atmosphere upon the intermediate annealing is not particularly limited, but for example, atmosphere gas (drying) containing 20% $H_2$ by a volume percentage and the remainder consisting of $N_2$ is used. The cooling rate of the steel sheet after the intermediate annealing is not particularly limited, but is, for example, 5.0 to 60.0° C./sec.

If the intermediate annealing is completed under the conditions described above, as a cold-rolled steel sheet to be obtained, a cold-rolled steel sheet according to the present embodiment in which the α-fiber ratio (within a tolerance of 10°) when the surface is measured by the SEM-EBSD is 15.0% or more, is obtained. As such, in order to set the α-fiber ratio (within a tolerance of 10°) to 15.0% or more in a stage before the skin pass rolling, it is required to use an α-γ transformation system composition (high concentration of γ-former elements of Mn, Ni, and Cu, hereinafter represented as high Mn and the like) and the above-described conditions from the hot rolling to the intermediate annealing, and particularly, the cooling conditions after the finish rolling are important. The α-fiber, which is easily generated in the {411}<011> orientation, is developed by transforming from the partially recrystallized austenite into ferrite, cold-rolling the hot-rolled steel sheet having an average grain size of 3 to 10 μm after the hot-rolling, and then intermediate annealing the steel sheet. As described above, when the rapid cooling immediately after is performed, the unrecrystallized austenite becomes a transformed structure, and a structure transformed from the partially recrystallized austenite is not obtained.

The skin pass rolling and the final annealing are performed on the cold-rolled steel sheet manufactured as described above under conditions to be described below, thereby obtaining the non-oriented electrical steel sheet according to the present embodiment.

(Skin Pass Rolling Step)

If the intermediate annealing is completed, skin pass rolling is performed next. Specifically, rolling (cold rolling) is performed on the cold-rolled steel sheet after the intermediate annealing step at normal temperature and in the air. Here, for the skin pass rolling, for example, a reverse rolling mill represented by the above-described Sendzimir rolling mill or the tandem rolling mill is used. The non-oriented electrical steel sheet (after the skin pass rolling and before the final annealing) is obtained by the skin pass rolling.

In the skin pass rolling, rolling is performed without performing the annealing treatment in the middle. For example, in a case where the reverse rolling is performed to perform the skin pass rolling in the plurality of passes, the plurality of passes of rolling is performed without performing the annealing treatment between the passes. The reverse type rolling mill may be used to perform skin pass rolling with only one pass. In addition, in a case where the skin pass rolling is performed using the tandem-type rolling mill, the rolling is performed continuously in the plurality of passes (passes of respective rolling stands).

As described above, in the present embodiment, after the strain is introduced into the steel sheet by the hot rolling and the cold rolling, the strain introduced into the steel sheet is temporarily reduced by the intermediate annealing. Then, the skin pass rolling is performed. As a result, the intermediate annealing is performed while reducing the excessively introduced strain by the cold rolling, thereby preferentially preventing occurrence of recrystallization of the {111} grains, and remaining the grains in the {411}<011> crystal orientation on the steel sheet surface. Then, the appropriate strain amount is introduced into each crystal grain in the steel sheet in the skin pass rolling, and is in a state in which the grain growth by bulging easily occurs in final annealing of the next process.

In the present embodiment, a rolling reduction RR2 in the skin pass rolling is 5% to 20%. Here, the rolling reduction RR2 is defined as follows.

Rolling reduction RR2(%)=(1−sheet thickness after plurality of final passes of rolling in skin pass rolling/sheet thickness before first pass of rolling in skin pass rolling)×100

Here, if the rolling reduction RR2 is less than 5%, a strain amount becomes too small, and a final annealing time required for the grain growth due to bulging becomes long. On the other hand, if the rolling reduction RR2 exceeds 20%, the strain amount becomes too large, normal grain growth occurs without bulging, and a {411}<148> or {111}<112> grow by the final annealing. Therefore, the rolling reduction RR2 is 5% to 20%.

The number of passes in the skin pass rolling may be only one pass (that is, only one rolling), or may be the plurality of passes of rolling.

As described above, the steel sheet having the α-γ transformation system composition (high Mn and the like) is recrystallized by the intermediate annealing, and is subjected to skin pass rolling under the above conditions, thereby obtaining the number average value Gs of the GOS value and the α-fiber ratio.

The skin pass rolling performed in the present embodiment has a significantly different effect from the skin pass rolling performed after the final annealing. By performing the hot rolling, the cooling, the cold rolling, the intermediate annealing, the skin pass rolling, and the final annealing in this order under predetermined conditions, a predetermined structure can be obtained.

(Final Annealing Step)

Final annealing is performed on the non-oriented electrical steel sheet after the skin pass rolling at 750° C. or higher and the Ac1 temperature or lower for 2 hours or longer. When the final annealing temperature T2 (° C.) is lower than 750° C., grain growth due to bulging does not occur sufficiently. In this case, an accumulation degree in the {411}<011> orientation is reduced. In addition, when the final annealing temperature T2 (° C.) exceeds the Ac1 temperature, a part of the structure in the steel sheet is transformed into austenite, such that the grain growth due to bulging does not occur, and a desired {411}<011> ratio is not obtained. In addition, when the annealing time is shorter than 2 hours, even if the final annealing temperature T2 (° C.) is 750° C. or higher and the Ac1 temperature or lower, the grain growth due to bulging does not sufficiently occur, and the accumulation degree in the {411}<011> orientation is thus reduced. The annealing time of the final annealing is not particularly limited, but a preferred upper limit is 10 hours because the effect is saturated even if the annealing time exceeds 10 hours.

A temperature rising rate TR2 up to the final annealing temperature T2 in the final annealing step may be any temperature rising rate well known to those skilled in the art. Examples of the temperature rising rate TR2 include, but are not limited to, 40° C./hour or more and less than 200° C./hour.

The temperature rising rate TR2 is obtained by the following method. A thermocouple is attached to the steel sheet having the above-described chemical composition and obtained by performing the steps from the hot rolling to the skin pass, thereby obtaining a sample steel sheet. The sample steel sheet attached with the thermocouple is heated, and a time from the start of the heating to the reach of the final annealing temperature T2 is measured. The temperature rising rate TR2 is obtained based on the measured time.

The atmosphere during the final annealing step is not particularly limited. The atmosphere during the final annealing step may be, for example, atmosphere gas (drying) containing 20% $H_2$ by a volume percentage and the remainder consisting of $N_2$, or a 100% hydrogen atmosphere. The cooling rate of the steel sheet after the final annealing is not particularly limited. The cooling rate is, for example, 5 to 20° C./sec.

The non-oriented electrical steel sheet after the skin pass rolling may be punched and/or stacked without performing the final annealing as the next step of the skin pass rolling step, and thereafter, may be final-annealed that also serves as stress relief annealing under conditions of the annealing temperature of 750° C. or higher and the Ac1 temperature or lower and the annealing time of 2 hours or longer. Further, after the skin pass rolling step, the steel sheet that has been final-annealed may be punched and/or stacked to be subjected to the stress relief annealing.

According to the above manufacturing method, the non-oriented electrical steel sheet according to the present embodiment (including a case of the non-oriented electrical steel sheet as a part of the core when punching, stacking, and stress relief annealing have been performed) can be manufactured.

In the method for manufacturing the non-oriented electrical steel sheet according to the present embodiment, for example, shot blasting and/or pickling may be performed after the cooling step and before the cold rolling step in the above manufacturing steps. In the shot blasting, shot blasting is performed on the steel sheet after the hot rolling, and scales formed on the surface of the steel sheet after the hot rolling is fractured and removed. In the pickling, a pickling treatment is performed on the steel sheet after the hot rolling. In the pickling treatment, for example, an aqueous hydrochloric acid solution is used as a pickling bath. The scales formed on the surface of the steel sheet is removed by the pickling. After the cooling step and before the cold rolling step, the shot blasting may be performed, and then the pickling may be performed. In addition, after the cooling step and before the cold rolling step, the pickling is performed, and the shot blasting does not have to be performed. After the cooling step and before the cold rolling step, the shot blasting is performed, and the pickling does not have to be performed. The shot blasting and the pickling are optional steps. Therefore, both the shot blasting step and the pickling step do not have to be performed.

(Insulation Coating Forming Step)

Furthermore, in the method for manufacturing an electrical steel sheet according to the present embodiment, an insulation coating may be formed on a surface of the steel sheet after the final annealing (non-oriented electrical steel sheet) by coating after the final annealing step. An insulation coating forming step is an optional step. Therefore, the coating does not have to be performed after the final annealing.

A type of the insulation coating is not particularly limited. The insulation coating may be an organic component or an inorganic component, and the insulation coating may contain the organic component and the inorganic component. The inorganic components are, for example, components based on dichromic acid-boric acid, phosphoric acid, silica, and the like. The organic components are, for example, general resins based on acrylics, acrylic styrene, acrylic silicon, silicon, polyester, epoxy, and fluorine. Considering coatability, a preferable resin is an emulsion type resin. The insulation coating that exhibits adhesiveness by heating and/or pressurizing may be performed. The insulation coating having the adhesiveness is, for example, resins based on acrylics, phenol, epoxy, and melamine.

The non-oriented electrical steel sheet according to the present embodiment is not limited to the above-described manufacturing method. The manufacturing method is not limited as long as the non-oriented electrical steel sheet has a predetermined chemical composition, and the area ratio of crystal grains having a {411}<011> orientation (within a tolerance of 10°) to the entire visual field when the surface is measured by electron back scattering diffraction (EBSD) is 15.0% or more, and the average grain size is 50 μm or more and 150 μm or less.

The core according to the present embodiment is obtained by processing a non-oriented electrical steel sheet after the skin pass rolling (before the final annealing) according to the present embodiment into a core by a known method.

For example, the core can be manufactured by punching and/or stacking the non-oriented electrical steel sheet after the skin pass rolling (before the final annealing) according to the present embodiment.

In addition, the core can be manufactured by punching and/or stacking the non-oriented electrical steel sheet after the skin pass rolling (before the final annealing) according to the present embodiment and annealing at the annealing temperature of 750° C. or higher and the Ac1 temperature or lower and at the annealing time of 2 hours or longer.

Moreover, the core according to the present embodiment is obtained by processing the non-oriented electrical steel sheet according to the present embodiment into a core by a known method.

A known method may be used for the method for manufacturing a core. For example, the core can be manufactured by punching and/or stacking the non-oriented electrical steel sheet according to the present embodiment. In addition, after the core is manufactured by the punching and/or stacking, the core can be manufactured by stress relief annealing.

In any of the above methods, the non-oriented electrical steel sheet after the punching may be integrated as a core using the insulation coating that exhibits caulking and adhesiveness. Examples of the punching and stacking method include a method for punching and stacking a stator as a core integrated with a rotor, a method for rotationally stacking the punched stator as a core integrated with the rotor, and a method for punching and stacking by aligning a direction having excellent magnetic characteristics of the steel sheet and a teeth and/or yoke direction as a segmented core.

EXAMPLES

Next, the non-oriented electrical steel sheet to the embodiment of the present invention will be specifically described with reference to Examples. Examples shown below are merely examples of the non-oriented electrical steel sheet according to the embodiment of the present invention, and the non-oriented electrical steel sheet according to the present invention is not limited to the following examples.

Example 1

A molten steel was cast to produce an ingot having a chemical composition shown in Table 1-1. Here, the left side of the equation represents a value on the left side in Equation (1). In addition, Mg and the like represents the total of one or more selected from the group consisting of Mg, Ca, Sr, Ba. Ce, La, Nd, Pr, Zn, and Cd. Thereafter, the produced ingot was heated to 1,150° C. hot-rolled, and finish-rolled at a finish rolling temperature FT shown in Table 1-2. Cooling was then performed under cooling conditions shown in Table 1-2 after the steel sheet has passed through the final pass (a time from when the steel sheet passes through the final pass in the finish rolling to when the cooling is started, and a temperature of the steel sheet 3 seconds later after the steel sheet has passed through the final pass).

Here, in order to examine a texture after cooling, a part of the steel sheet is cut off, and the average grain size was measured by an intercept method on a plane parallel to a rolled surface at a depth of ½ of a sheet thickness from the surface. The measurement results are shown in Table 1-2.

Next, the hot-rolled steel sheet was not annealed, and the scales were removed by pickling, and cold rolling was performed at a rolling reduction RR1 shown in Table 1-2. The intermediate annealing was then performed to be held for 30 seconds by controlling a temperature rising rate to 15.0° C./sec and controlling the intermediate annealing temperature T1 to a temperature shown in Table 1-2, in the atmosphere containing 20% hydrogen and 80% nitrogen by a volume percentage.

Here, in order to examine a texture of the cold-rolled steel sheet before the skin pass rolling, a part of the steel sheet was cut off, and a test piece of the cut steel sheet was reduced to a thickness of ½. An {hkl}<011> orientation was extracted (within a tolerance of 10°) in a measurement region of the processed surface by SEM-EBSD using OIM Analysis 7.3, and an area of the extracted orientation was divided by an area of the measurement region to obtain an α-fiber ratio $A_{s\alpha}$. The results are shown in Table 2-1.

Next, skin pass rolling was performed at a rolling reduction RR2 shown in Table 1-2.

Before the final annealing, in order to examine a texture after the skin pass rolling, a part of the steel sheet was cut off, and a test piece of the cut steel sheet was reduced to a thickness of ½. An α-fiber ratio $A_{s\alpha}$ of the processed surface was obtained in the same manner as in the procedure described above. In addition, as for the ODF intensity of the {100}<011> orientation, an ODF value of the {100}<011> orientation obtained by creating an ODF under the above-described conditions using OIM Analysis 7.3 in the measurement region of the processed surface by the SEM-EBSD, and outputting data of the created ODF, was set as the ODF intensity. Furthermore, as for Gs, the number average value of the GOS value obtained by Analysis with OIM Analysis 7.3 using SEM-EBSD data was set as Gs. Each result is shown in Table 2-1.

Next, the steel sheet after the skin pass rolling was final annealed in an atmosphere of 100% hydrogen at a temperature rising rate of 100° C./hour and at the final annealing temperature T2 shown in Table 1-2. Here, a retention time at the final annealing temperature T2 was set to 2 hours.

In order to examine a texture after the final annealing, a part of the steel sheet was cut off, and a test piece of the cut steel sheet was reduced to a thickness of ½. The {411}<011> ratio, A411-011/A411-148, and A411-011/A100-011 were obtained by observation in the measurement region of the processed surface by the SEM-EBSD under the above-described measurement conditions. Further, as for φ1 (°) indicating the maximum intensity (φ1 at maximum intensity) in the {411}<uvw> orientation and Φ (°) (Φ at maximum intensity) indicating the maximum intensity in the {hkl}<11> orientation, points having the maximum ODF value within a specific orientation range were set as maximum intensities of φ1 and Φ, the ODF value obtained by creating the ODF under the above-described conditions in the measurement region of the processed surface by the SE-M-EBSD using OIM Analysis 7.3, and outputting data of the created ODF. Each result is shown in Table 2-1.

Moreover, in order to examine the magnetic characteristics after the final annealing, a magnetic flux density B50 and an iron loss W10/400 were measured, and an iron loss deterioration ratio of the iron loss W10/50 under a compressive stress was obtained as an index of stress sensitivity. The magnetic flux density B50 was obtained by collecting a single plate sample for testing magnetic characteristics of a 55 mm square in two directions of 0° and 45° in the rolling direction as a measurement sample. Then, these two samples were measured to set a value in the 45° direction with respect to the rolling direction as a magnetic flux density B50 in the 45° direction and set an average value at 0°, 45° 90°, and 135° with respect to the rolling direction as a whole circumference average of the magnetic flux density B50. The iron loss W10/400 was obtained by using the above-described measurement sample collected in the 45° direction in the rolling direction. Furthermore, the iron loss deterioration ratio $W_x$ [%] of the iron loss W10/50 in the 450 direction under the compressive stress was obtained by calculating the iron loss deterioration ratio $W_x$ by the following Equation, where the iron loss W10/50 (45° direction) with no stress was set as W10/50(0), and the iron loss W10/50 (45° direction) under the compressive stress of 10 MPa was set as W10/50(10). The measurement results are shown in Table 2-2.

$$W_x = \{W10/50(10) - W10/50(0)\}/W10/50(0)$$

When a magnetic flux density B50 (B50 (45°) in the 45° direction with respect to the rolling direction is 1.70 T or more, the iron loss W10/400 (W100/400 (45°) in the 450 direction with respect to the rolling direction is 13.8 W/kg or less, and the iron loss deterioration ratio of W10/50 under the compressive stress in the 450 direction with respect to the rolling direction is 40% or less, it was determined that the magnetic characteristics in the 45° direction was excellent.

TABLE 1-1

| | Item | | | | | | | | | | | | | | |
|---|---|---|---|---|---|---|---|---|---|---|---|---|---|---|---|
| | Chemical Composition (Remainder of FE and Impurities) | | | | | | | | | | | | | | |
| No. | C [mass %] | Si [mass %] | sol. Al [mass %] | S [mass %] | N [mass %] | Mn [mass %] | Cu [mass %] | Ni [mass %] | Total of Mn, Cu, and Ni [mass %] | Co [mass %] | Sn [mass %] | Sb [mass %] | P [mass %] | Mg and The Like [mass %] | Left Side in Equation |
| 101 | 0.0018 | 2.50 | 0.005 | 0.0018 | 0.0011 | 3.0 | | | 3.0 | — | — | — | 0.020 | — | 3.41 |
| 102 | 0.0018 | 2.50 | 0.005 | 0.0018 | 0.0011 | 3.0 | | | 3.0 | — | — | — | 0.020 | — | 3.41 |
| 103 | 0.0018 | 2.50 | 0.005 | 0.0018 | 0.0011 | 2.0 | | | 2.0 | — | — | — | 0.020 | — | 1.41 |
| 104 | 0.0018 | 2.50 | 0.005 | 0.0018 | 0.0011 | 2.0 | | | 2.0 | — | — | — | 0.020 | — | 1.41 |
| 105 | 0.0018 | 2.50 | 0.005 | 0.0018 | 0.0011 | 3.0 | | | 3.0 | — | — | — | 0.020 | — | 3.41 |
| 106 | 0.0009 | 2.50 | 0.07 | 0.0.008 | 0.0008 | 4.0 | | | 4.0 | — | — | 0.11 | 0.080 | — | 5.04 |
| 107 | 0.0009 | 2.50 | 0.07 | 0.0008 | 0.0008 | 4.0 | | | 4.0 | — | — | 0.11 | 0.080 | — | 5.04 |
| 108 | 0.0009 | 2.50 | 0.07 | 0.0008 | 0.0008 | 4.0 | | | 4.0 | — | — | 0.11 | 0.080 | — | 5.04 |
| 109 | 0.0009 | 2.50 | 0.07 | 0.0008 | 0.0008 | 4.0 | | | 4.0 | — | — | 0.11 | 0.080 | — | 5.04 |
| 110 | 0.0009 | 2.50 | 0.07 | 0.0008 | 0.0008 | 4.0 | | | 4.0 | — | — | 0.11 | 0.080 | — | 5.04 |
| 111 | 0.0009 | 2.50 | 0.07 | 0.0008 | 0.0008 | 4.0 | | | 4.0 | — | — | 0.11 | 0.080 | — | 5.04 |
| 112 | 0.0025 | 2.50 | 0.0008 | 0.0009 | 0.0025 | 3.1 | | | 3.1 | — | — | — | 0.035 | — | 3.56 |

TABLE 1-2

| No. | Item: Transformation Point: Ar3 Temperature [° C.] | Ar1 Temperature [° C.] | Ac1 Temperature [° C.] | Hot Rolling Step Finish Rolling Temperature FT [° C.] | Cooling Step: Time to Start Cooling sec | Temperature After 3 Seconds [° C.] |
|---|---|---|---|---|---|---|
| 101 | 815 | 779 | 932 | 950 | 0.10 | 700 |
| 102 | 815 | 779 | 932 | 950 | 0.10 | 200 |
| 103 | — | 850 | 900 | 950 | 0.10 | 700 |
| 104 | — | 850 | 900 | 950 | 0.10 | 200 |
| 105 | 815 | 779 | 932 | 650 | 0.10 | 550 |
| 106 | 710 | 650 | 850 | 850 | 0.08 | 600 |
| 107 | 710 | 650 | 850 | 850 | 0.12 | 600 |
| 108 | 710 | 650 | 850 | 850 | 1.30 | 600 |
| 109 | 710 | 650 | 850 | 850 | 0.12 | 320 |
| 110 | 710 | 650 | 850 | 850 | 0.12 | 280 |
| 111 | 710 | 650 | 850 | 850 | 0.12 | 750 |
| 112 | 805 | 775 | 925 | 900 | 0.15 | 350 |

| No. | Item: After Hot Rolling Average Grain Size [μm] | Cold Rolling Step Rolling Reduction RR1 [%] | Intermediate annealing Step Annealing Temperature T1 [° C.] | Skin Pass Rolling Step Rolling Reduction RR2 [%] | Final Annealing Step Annealing Temperature T2 [° C.] | Evaluation |
|---|---|---|---|---|---|---|
| 101 | 5.0 | 86 | 700 | 15 | 800 | Inventive Example |
| 102 | 4.2 | 86 | 700 | 15 | 800 | Comparative Example |
| 103 | 13.8 | 86 | 700 | 15 | 800 | Comparative Example |
| 104 | 11.5 | 86 | 700 | 15 | 800 | Comparative Example |
| 105 | 13.8 | 86 | 700 | 15 | 800 | Comparative Example |
| 106 | 4.9 | 86 | 700 | 15 | 800 | Comparative Example |
| 107 | 5.1 | 86 | 700 | 15 | 800 | Inventive Example |
| 108 | 5.1 | 86 | 700 | 15 | 800 | Inventive Example |
| 109 | 4.8 | 86 | 700 | 15 | 800 | Inventive Example |
| 110 | 4.5 | 86 | 700 | 15 | 800 | Comparative Example |
| 111 | 16.3 | 86 | 700 | 15 | 800 | Comparative Example |
| 112 | 4.5 | 93 | 725 | 13 | 850 | Inventive Example |

TABLE 2-1

| No. | Item: Texture After Intermediate annealing α-Fiber Ratio $A_{\alpha\alpha}$ [%] | Texture After Skin Pass: α-Fiber Ratio $A_{s\alpha}$ [%] | {100}<011> ODF Intensity [—] | Gs [—] | Texture After Final Annealing: {411}<011> Ratio [%] | φ1 at {411}<uvw> ODF max [°] | Φ at {hkl}<011> ODF max [°] | A411-011/A411-148 [—] | A411-011/A100-011 [—] |
|---|---|---|---|---|---|---|---|---|---|
| 101 | 32.1 | 32.9 | 7.6 | 2.2 | 29.2 | 0 | 20 | 1.5 | 3.0 |
| 102 | 35.8 | 36.7 | 20.2 | 1.7 | 11.2 | 0 | 0 | 1.2 | 0.3 |
| 103 | 8.7 | 9.5 | 2.8 | 2.4 | 8.3 | 20 | 50 | 0.3 | 1.1 |
| 104 | 10.4 | 11.2 | 3.1 | 2.5 | 9.6 | 20 | 55 | 0.5 | 0.8 |

TABLE 2-1-continued

| No. | Texture After Intermediate annealing α-Fiber Ratio $A_{\alpha\alpha}$ [%] | Texture After Skin Pass: α-Fiber Ratio $A_{s\alpha}$ [%] | Texture After Skin Pass: {100}<011> ODF Intensity [—] | Texture After Skin Pass: Gs [—] | Texture After Final Annealing: {411}<011> Ratio [%] | Texture After Final Annealing: φ1 at {411}<uvw> ODF max [°] | Texture After Final Annealing: Φ at {hkl}<011> ODF max [°] | Texture After Final Annealing: A411-011/A411-148 [—] | Texture After Final Annealing: A411-011/A100-011 [—] |
|---|---|---|---|---|---|---|---|---|---|
| 105 | 12.5 | 13.6 | 3.4 | 2.6 | 10.2 | 20 | 55 | 0.8 | 1.5 |
| 106 | 33.4 | 34.8 | 19.7 | 1.8 | 14.8 | 0 | 0 | 1.2 | 0.3 |
| 107 | 35.2 | 36.1 | 8.2 | 2.1 | 30.9 | 0 | 20 | 1.6 | 3.5 |
| 108 | 32.1 | 32.9 | 7.8 | 2.5 | 29.2 | 0 | 20 | 1.5 | 3.3 |
| 109 | 32.1 | 32.9 | 9.1 | 1.9 | 29.2 | 0 | 20 | 1.5 | 5.2 |
| 110 | 32.9 | 34.8 | 19.9 | 1.3 | 11.8 | 0 | 0 | 1.2 | 0.7 |
| 111 | 12.5 | 13.6 | 2.4 | 2.6 | 10.2 | 20 | 55 | 0.8 | 1.5 |
| 112 | 35.0 | 35.9 | 8.5 | 2.5 | 25.8 | 0 | 25 | 1.5 | 0.8 |

TABLE 2-2

| No. | Sheet Thickness [mm] | Microstructure Average Grain Size [μm] | Magnetic Characteristics: B50 (Whole Circumference) [T] | Magnetic Characteristics: B50 (45°) [T] | Magnetic Characteristics: W10/400 (45°) [W/kg] | Magnetic Characteristics: Iron Loss Deterioration Ratio $W_x$ [%] | Evaluation |
|---|---|---|---|---|---|---|---|
| 101 | 0.30 | 69.2 | 1.64 | 1.75 | 12.9 | 31.3 | Inventive Example |
| 102 | 0.30 | 57.3 | 1.62 | 1.73 | 12.7 | 50.7 | Comparative Example |
| 103 | 0.30 | 70.4 | 1.65 | 1.60 | 14.3 | 54.5 | Comparative Example |
| 104 | 0.30 | 81.2 | 1.67 | 1.62 | 14.1 | 52.3 | Comparative Example |
| 105 | 0.30 | 62.4 | 1.66 | 1.61 | 14.5 | 46.2 | Comparative Example |
| 106 | 0.30 | 57.3 | 1.62 | 1.73 | 12.9 | 50.7 | Comparative Example |
| 107 | 0.30 | 69.2 | 1.64 | 1.72 | 13.4 | 30.5 | Inventive Example |
| 108 | 0.30 | 70.4 | 1.64 | 1.74 | 13.2 | 33.8 | Inventive Example |
| 109 | 0.30 | 62.5 | 1.64 | 1.75 | 13.1 | 25.7 | Inventive Example |
| 110 | 0.30 | 63.7 | 1.63 | 1.73 | 13.0 | 48.2 | Comparative Example |
| 111 | 0.30 | 62.4 | 1.66 | 1.61 | 14.0 | 46.2 | Comparative Example |
| 112 | 0.30 | 95.2 | 1.66 | 1.73 | 13.5 | 39.5 | Inventive Example |

Underlines in Table 1-1, Table 1-2, Table 2-1, and Table 2-2 indicate conditions deviating from the scope of the present invention.

Nos. 101, 107 to 109, and 112 of Inventive Examples had good values for all of the magnetic flux density B50 (45° direction), the iron loss W10/400, and the iron loss deterioration ratio. On the other hand, Nos. 102 and 110 of Comparative Examples had large iron loss deterioration ratios under the compressive stress because the rapid cooling was performed after the finish rolling. Nos. 103 and 104 of Comparative Examples had poor magnetic flux density B50 (45° direction), iron loss W10/400, and iron loss deterioration ratio because of a composition with a high transformation point. No. 105 of Comparative Example had poor magnetic flux density B50 (45° direction), iron loss W10/400, and iron loss deterioration ratio because the finish rolling temperature FT was lower than the Ar1 temperature. No. 106 of Comparative Example had a large iron loss deterioration ratio under the compressive stress because a time from when the steel sheet passes through the final pass in the finish rolling to when the cooling is started was too short. No. 111 of Comparative Example had poor magnetic flux density B50 (45° direction), iron loss W10/400, and iron loss deterioration ratio because a temperature in the stage until 3 seconds have elapsed after the steel sheet has passed through the final pass in the finish rolling was higher than the Ar1 temperature.

Example 2

A molten steel was cast to produce an ingot having a chemical composition shown in Table 3-1. Here, the left side of the equation represents a value on the left side in Equation (1). In addition, Mg and the like represents the total of one or more selected from the group consisting of Mg, Ca, Sr, Ba, Ce, La, Nd, Pr, Zn, and Cd. Thereafter, the produced ingot was heated to 1,150° C., hot-rolled, and finish-rolled at a finish rolling temperature FT shown in Table 3-2. Cooling was then performed under cooling conditions shown in Table 3-2 after the steel sheet has passed through the final pass (a time from when the steel sheet passes through the final pass in the finish rolling to when the cooling is started, and a temperature of the steel sheet 3 seconds later after the steel sheet has passed through the final pass).

Here, in order to examine the texture after the cooling, an average grain size was measured by the same procedure as in Example 1. The measurement results are shown in Table 3-2.

Next, the hot-rolled steel sheet was not annealed, and the scales were removed by pickling, and cold rolling was performed at a rolling reduction RR1 shown in Table 3-2. Then, intermediate annealing was performed to be held for 30 seconds by performing the intermediate annealing in the atmosphere containing 20% hydrogen and 80% nitrogen by volume percentage and controlling the intermediate annealing temperature T1 to a temperature shown in Table 3-2.

Here, in order to examine the texture of the cold-rolled steel sheet before the skin pass rolling, an α-fiber ratio was obtained by the same procedure as in Example 1. The results are shown in Table 4-1.

Next, skin pass rolling was performed at a rolling reduction RR2 shown in Table 3-2.

Before the final annealing, in order to examine the texture after the skin pass rolling, an α-fiber ratio and Gs were obtained by the same procedure as in Example 1. Each result is shown in Table 4-1.

Next, the final annealing was performed at the final annealing temperature T2 shown in Table 3-2 in the atmosphere of 100% hydrogen. Here, a retention time at the final annealing temperature T2 was set to 2 hours.

In order to examine a texture after the final annealing, the {411}<011> ratio, the maximum intensity of φ1 and Φ. A411-011/A411-148, and A411-011/A100-011 are obtained in the same procedure as in Example 1. Each result is shown in Table 4-1.

Moreover, in order to examine the magnetic characteristics after the final annealing, a magnetic flux density B50 and an iron loss W10/400 were measured, and an iron loss deterioration ratio $W_x$ of the iron loss W10/50 under a compressive stress was obtained as an index of stress sensitivity. The measurement procedure is the same as that in Example 1. The measurement results are shown in Table 4-2.

TABLE 3-1

| | Item Chemical Composition (Remainder of Fe And Impurities) | | | | | | | | | | | | | | |
|---|---|---|---|---|---|---|---|---|---|---|---|---|---|---|---|
| No. | C [mass %] | Si [mass %] | sol. Al [mass %] | S [mass %] | N [mass %] | Mn [mass %] | Cu [mass %] | Ni [mass %] | Total of Mn, Cu, And Ni [mass %] | Co [mass %] | Sn [mass %] | Sb [mass %] | P [mass %] | Mg And The Like [mass %] | Left Side in Equation |
| 201 | 0.0012 | 2.60 | 0.50 | 0.0015 | 0.0014 | 2.4 | | | 2.4 | — | 0.15 | — | 0.010 | — | 1.16 |
| 202 | 0.0012 | 2.60 | 0.50 | 0.0015 | 0.0014 | 2.6 | | | 2.6 | — | 0.15 | — | 0.010 | — | 1.56 |
| 203 | 0.0012 | 2.60 | 0.50 | 0.0015 | 0.0014 | 4.4 | | | 4.4 | — | 0.15 | — | 0.010 | — | 5.16 |
| 204 | 0.0012 | 2.60 | 0.50 | 0.0015 | 0.0014 | 5.2 | | | 5.2 | — | 0.15 | — | 0.010 | — | 6.76 |
| 205 | 0.0012 | 2.50 | 0.50 | 0.0015 | 0.0014 | 2.5 | | | 2.5 | — | 0.15 | — | 0:010 | — | 1.48 |
| 206 | 0.0012 | 3.00 | 0.50 | 0.0015 | 0.0014 | 3.5 | | | 3.5 | — | 0.15 | — | 0.010 | — | 2.96 |
| 207 | 0.0012 | 3.00 | 1.00 | 0.0015 | 0.0014 | 3.0 | | | 3.0 | — | 0.15 | — | 0.010 | — | 0.98 |
| 208 | 0.0012 | 1.00 | 0.01 | 0.0015 | 0.0014 | 2.5 | | | 2.5 | — | 0.15 | — | 0.010 | — | 3.95 |
| 209 | 0.0012 | 2.40 | 0.12 | 0.0015 | 0.0014 | 2.4 | | 0.2 | 2.6 | — | 0.15 | — | 0.010 | — | 2.62 |
| 210 | 0.0012 | 2.40 | 0.12 | 0.0015 | 0.0014 | 0.2 | | 2.4 | 2.6 | — | 0.15 | — | 0.010 | — | 3.72 |
| 211 | 0.0012 | 2.40 | 0.12 | 0.0015 | 0.0014 | 2.5 | | | 2.5 | 0.2 | 0.15 | — | 0.010 | — | 2.12 |
| 212 | 0.0012 | 2.40 | 0.12 | 0.0015 | 0.0014 | 2.4 | 0.2 | | 2.6 | — | 0.15 | — | 0.010 | — | 2.32 |
| 213 | 0.0012 | 3.10 | 1.00 | 0.0015 | 0.0014 | 0.2 | 2.4 | | 2.6 | — | 0.15 | — | 0.010 | — | −2.34 |

TABLE 3-2

| No. | Item: Transformation Point: Ar3 Temperature [° C.] | Ar1 Temperature [° C.] | Ac1 Temperature [° C.] | Hot Rolling Step Finish Rolling Temperature FT [° C.] | Cooling Step: Time to Start Cooling sec | Temperature After 3 Seconds [° C.] |
|---|---|---|---|---|---|---|
| 201 | — | 900 | 980 | 950 | 0.50 | 700 |
| 202 | 880 | 804 | 975 | 950 | 0.50 | 400 |
| 203 | 730 | 657 | 869 | 950 | 0.50 | 400 |
| 204 | 710 | 603 | 814 | 950 | 0.50 | 400 |
| 205 | — | 890 | 970 | 950 | 0.50 | 400 |
| 206 | 840 | 742 | 911 | 950 | 0.50 | 400 |
| 207 | — | — | — | 950 | 0.50 | 400 |
| 208 | 820 | 701 | 899 | 950 | 0.50 | 400 |
| 209 | 830 | 751 | 924 | 950 | 0.50 | 400 |
| 210 | 805 | 708 | 904 | 950 | 0.50 | 400 |
| 211 | 890 | 798 | 966 | 950 | 0.50 | 400 |
| 212 | 870 | 762 | 933 | 950 | 0.50 | 400 |
| 213 | — | — | — | 950 | 0.50 | 400 |

| No. | Item: After Hot Rolling Average Grain Size [μm] | Cold Rolling Step Rolling Reduction RR1 [%] | Intermediate annealing Step Annealing Temperature T1 [° C.] | Skin Pass Rolling Step Rolling Reduction RR2 [%] | Final Annealing Step Annealing Temperature T2 [° C.] | Evaluation |
|---|---|---|---|---|---|---|
| 201 | 13.4 | 86 | 700 | 15 | 800 | Comparative Example |
| 202 | 5.0 | 86 | 700 | 15 | 800 | Inventive Example |
| 203 | 5.2 | 86 | 700 | 15 | 800 | Inventive Example |
| 204 | 5.3 | 86 | 700 | 15 | 800 | Comparative Example |
| 205 | 12.4 | 86 | 700 | 15 | 800 | Comparative Example |
| 206 | 5.0 | 86 | 700 | 15 | 800 | Inventive Example |
| 207 | 12.8 | 86 | 700 | 15 | 800 | Comparative Example |
| 208 | 5.2 | 86 | 700 | 51 | 800 | Comparative Example |
| 209 | 5.2 | 86 | 700 | 15 | 800 | Inventive Example |
| 210 | 5.1 | 86 | 700 | 15 | 800 | Inventive Example |
| 211 | 4.8 | 86 | 700 | 15 | 800 | Inventive Example |
| 212 | 5.5 | 86 | 700 | 15 | 800 | Inventive Example |
| 213 | 12.3 | 86 | 700 | 51 | 800 | Comparative Example |

TABLE 4-1

| No. | Item: Texture After Intermediate annealing α-Fiber Ratio $A_{\alpha\alpha}$ [%] | Texture After Skin Pass: α-Fiber Ratio $A_{s\alpha}$ [%] | {100}<011> ODF Intensity [—] | Gs [—] | Texture After Final Annealing: {411}<011> Ratio [%] | φ1 at {411}<uvw> ODF max [°] | Φ at {hkl}<011> ODF max [°] | A411-011/A411/148 [—] | A411-011/A100-011 [—] |
|---|---|---|---|---|---|---|---|---|---|
| 201 | 7.2 | 8.9 | 2.4 | 2.5 | 7.3 | 20 | 55 | 0.4 | 1 |
| 202 | 27.4 | 28.1 | 7.7 | 2.0 | 27.3 | 0 | 20 | 1.4 | 2.7 |

TABLE 4-1-continued

| No. | Texture After Intermediate annealing α-Fiber Ratio $A_{\alpha\alpha}$ [%] | Texture After Skin Pass: α-Fiber Ratio $A_{s\alpha}$ [%] | Texture After Skin Pass: {100}<011> ODF Intensity [—] | Texture After Skin Pass: Gs [—] | Texture After Final Annealing: {411}<011> Ratio [%] | Texture After Final Annealing: φ1 at {411}<uvw> ODF max [°] | Texture After Final Annealing: Φ at {hkl}<011> ODF max [°] | Texture After Final Annealing: A411-011/A411/148 [—] | Texture After Final Annealing: A411-011/A100-011 [—] |
|---|---|---|---|---|---|---|---|---|---|
| 203 | 32.1 | 32.9 | 8.3 | 2.2 | 29.2 | 0 | 20 | 1.5 | 3.0 |
| 204 | 30.4 | 31.1 | 8.1 | 2.3 | 28.6 | 0 | 20 | 1.3 | 2.9 |
| 205 | 8.2 | 9.1 | 2.7 | 2.6 | 6.2 | 20 | 50 | 0.3 | 0.9 |
| 206 | 30.9 | 32.0 | 8.5 | 2.0 | 28.2 | 0 | 20 | 1.7 | 4.9 |
| 207 | 6.8 | 7.8 | 2.7 | 2.5 | 6.7 | 20 | 55 | 0.4 | 0.9 |
| 208 | 31.2 | 32.2 | 8.0 | 2.1 | 27.5 | 0 | 20 | 1.6 | 4.6 |
| 209 | 41.7 | 42.0 | 10.2 | 2.3 | 28.4 | 0 | 20 | 1.4 | 4.2 |
| 210 | 27.4 | 28.1 | 7.1 | 2.0 | 27.3 | 0 | 20 | 1.4 | 2.7 |
| 211 | 35.4 | 36.1 | 9.4 | 2.1 | 30.1 | 0 | 20 | 1.7 | 4.1 |
| 212 | 27.4 | 28.1 | 7.3 | 2.0 | 27.3 | 0 | 20 | 1.4 | 2.7 |
| 213 | 8.2 | 9.1 | 2.4 | 2.6 | 6.2 | 20 | 50 | 0.3 | 0.9 |

TABLE 4-2

| No. | Sheet Thickness [mm] | Microstructure Average Grain Size [μm] | Magnetic Characteristics: B50 (Whole Circumference) [T] | Magnetic Characteristics: B50 (45°) [T] | Magnetic Characteristics: W10/400 (45°) [W/kg] | Magnetic Characteristics: Iron Loss Deterioration Ratio $W_x$ [%] | Evaluation |
|---|---|---|---|---|---|---|---|
| 201 | 0.30 | 80.4 | 1.65 | 1.58 | 14.5 | 52.9 | Comparative Example |
| 202 | 0.30 | 78.1 | 1.61 | 1.70 | 13.3 | 30.4 | Inventive Example |
| 203 | 0.30 | 69.2 | 1.62 | 1.72 | 13.0 | 33.2 | Inventive Example |
| 204 | 0.30 | 64.8 | 1.51 | 1.48 | 13.2 | 31.9 | Comparative Example |
| 205 | 0.30 | 80.4 | 1.65 | 1.57 | 14.4 | 51.3 | Comparative Example |
| 206 | 0.30 | 66.9 | 1.64 | 1.73 | 13.3 | 29.9 | Inventive Example |
| 207 | 0.30 | 67.2 | 1.66 | 1.55 | 14.7 | 51.9 | Comparative Example |
| 208 | 0.30 | 71.1 | 1.67 | 1.74 | 15.4 | 30.1 | Comparative Example |
| 209 | 0.30 | 70.1 | 1.65 | 1.74 | 13.2 | 28.9 | Inventive Example |
| 210 | 0.30 | 78.1 | 1.61 | 1.70 | 13.3 | 30.4 | Inventive Example |
| 211 | 0.30 | 68.8 | 1.63 | 1.71 | 13.4 | 29.4 | Inventive Example |
| 212 | 0.30 | 78.1 | 1.61 | 1.70 | 13.3 | 30.4 | Inventive Example |
| 213 | 0.30 | 80.4 | 1.65 | 1.57 | 14.5 | 51.3 | Comparative Example |

Underlines in Table 3-1, Table 3-2, Table 4-1, and Table 4-2 indicate conditions deviating from the scope of the present invention.

Nos. 202, 203, 206, and 209 to 212 of Inventive Examples had good values for all of the magnetic flux density B50 in the 45° direction, the iron loss W10/400, and the iron loss deterioration ratio.

On the other hand, Nos. 201 and 205 of Comparative Examples had poor magnetic flux density B50 (45° direction), iron loss W10/400 (45° direction), and iron loss deterioration ratio because of a composition with a high transformation point, and Nos. 207 and 213 had poor magnetic flux density B50 (45° direction), iron loss W10/400 (45° direction), and iron loss deterioration ratio because they had a composition in which α-γ transformation does not occur. No. 204 of Comparative Example had high costs and poor magnetic flux density B50 (45° direction) because it excessively contained Mn. No. 208 of Comparative Example had poor iron loss W10/400 (45° direction) because the Si content was insufficient.

Example 3

A molten steel was cast to produce an ingot having a chemical composition shown in Table 5-1. Here, the left side of the equation represents a value on the left side in Equation (1). In addition, Mg and the like represents the total content of one or more selected from the group consisting of Mg, Ca. Sr, Ba, Ce, La, Nd, Pr, Zn, and Cd.

Thereafter, the produced ingot was heated to 1,150° C., hot-rolled, and finish-rolled at a finish rolling temperature FT shown in Table 5-2. Cooling was then performed under cooling conditions shown in Table 5-2 after the steel sheet has passed through the final pass (a time from when the steel sheet passes through the final pass in the finish rolling to when the cooling is started, and a temperature of the steel sheet 3 seconds later after the steel sheet has passed through the final pass).

Here, in order to examine the texture after the cooling, an average grain size was measured by the same procedure as in Example 1. The measurement results are shown in Table 5-2.

Next, the hot-rolled steel sheet was not annealed, and the scales were removed by pickling, and cold rolling was performed at a rolling reduction RR1 shown in Table 5-2. Then, intermediate annealing was performed to be held for 30 seconds by performing the intermediate annealing in the atmosphere containing 20% hydrogen and 80% nitrogen by a volume percentage and controlling the intermediate annealing temperature T1 to a temperature shown in Table 5-2.

Here, in order to examine the texture of the cold-rolled steel sheet before the skin pass rolling, an α-fiber ratio was obtained by the same procedure as in Example 1. The results are shown in Table 6-1.

Next, skin pass rolling was performed at a rolling reduction RR2 shown in Table 5-2.

Before the final annealing, in order to examine the texture after the skin pass rolling, an α-fiber ratio and Gs were obtained by the same procedure as in Example 1. Each result is shown in Table 6-1.

Next, the final annealing was performed at the final annealing temperature T2 shown in Table 5-2 in the atmosphere of 100% hydrogen. Here, a retention time at the final annealing temperature T2 was set to 2 hours.

In order to examine a texture after the final annealing, the {411}<011> ratio, the maximum intensity of φ1 and Φ, A411-011/A411-148, and A411-011/A100-011 were obtained in the same procedure as in Example 1. Each result is shown in Table 6-1.

Moreover, in order to examine the magnetic characteristics after the final annealing, a magnetic flux density B50 and an iron loss W10/400 were measured, and an iron loss deterioration ratio $W_x$ of the iron loss W10/50 under a compressive stress was obtained as an index of stress sensitivity. The measurement procedure is the same as that in Example 1. The measurement results are shown in Table 6-2.

TABLE 5-1

| | Item Chemical Composition (Remainder of Fe And Impurities) | | | | | | | | | | | | | | |
|---|---|---|---|---|---|---|---|---|---|---|---|---|---|---|---|
| No. | C [mass %] | Si [mass %] | sol. Al [mass %] | S [mass %] | N [mass %] | Mn [mass %] | Cu [mass %] | Ni [mass %] | Total of Mn, Cu, And Ni [mass %] | Co [mass %] | Sn [mass %] | Sb [mass %] | P [mass %] | Mg And The Like [mass %] | Left Side in Equation |
| 301 | 0.0022 | 3.43 | 0.02 | 0.0042 | 0.0023 | 3.7 | | | 3.7 | — | — | — | 0.006 | Mg: 0.005 | 3.91 |
| 302 | 0.0022 | 3.43 | 0.02 | 0.0042 | 0.0023 | 3.7 | | | 3.7 | — | — | — | 0.006 | Mg: 0.005 | 3.91 |
| 303 | 0.0022 | 3.43 | 0.02 | 0.0042 | 0.0023 | 3.7 | | | 3.7 | — | — | — | 0.006 | Mg: 0.005 | 3.91 |
| 304 | 0.0022 | 3.43 | 0.02 | 0.0042 | 0.0023 | 3.7 | | | 3.7 | — | — | — | 0.006 | Mg: 0.005 | 3.91 |
| 305 | 0.0022 | 3.43 | 0.02 | 0.0042 | 0.0023 | 3.7 | | | 3.7 | — | — | — | 0.006 | Mg: 0.005 | 3.91 |
| 306 | 0.0022 | 3.43 | 0.02 | 0.0042 | 0.0023 | 3.7 | | | 3.7 | — | — | — | 0.006 | Mg: 0.005 | 3.91 |
| 307 | 0.0022 | 3.43 | 0.95 | 0.0042 | 0.0023 | 2.2 | | | 2.2 | — | — | — | 0.006 | Mg: 0.005 | −0.95 |
| 308 | 0.0022 | 3.43 | 0.95 | 0.0042 | 0.0023 | 2.2 | | | 2.2 | — | — | — | 0.006 | Mg: 0.005 | −0.95 |
| 309 | 0.0022 | 3.43 | 0.95 | 0.0042 | 0.0023 | 2.9 | | | 2.9 | — | — | — | 0.006 | Mg: 0.005 | 0.45 |
| 310 | 0.0022 | 3.43 | 0.95 | 0.0042 | 0.0023 | 2.9 | | | 2.9 | — | — | — | 0.006 | Mg: 0.005 | 0.45 |
| 311 | 0.0022 | 2.20 | 0.10 | 0.0042 | 0.0023 | 2.4 | | | 2.4 | — | — | — | 0.006 | Mg: 0.005 | 2.38 |
| 312 | 0.0022 | 2.20 | 0.10 | 0.0042 | 0.0023 | 2.4 | | | 2.4 | — | — | — | 0.006 | Mg: 0.005 | 2.38 |
| 313 | 0.0013 | 3.10 | 0.30 | 0.0021 | 0.0011 | 3.5 | | | 3.5 | — | — | — | 0.100 | Mg: 0.002, Pr: 0.002 | 2.90 |
| 315 | 0.0013 | 3.10 | 0.30 | 0.0021 | 0.0011 | 3.5 | | | 3.5 | — | — | — | 0.100 | Sr: 0.002, Cd: .0002 | 2.90 |
| 316 | 0.0013 | 3.10 | 0.30 | 0.0021 | 0.0011 | 3.5 | | | 3.5 | — | — | — | 0.100 | Ba: 0.002, Zn: 0.002 | 2.90 |
| 317 | 0.0013 | 3.10 | 0.30 | 0.0021 | 0.0011 | 3.5 | | | 3.5 | — | — | — | 0.100 | La: 0.002, Nd: 0.002 | 2.90 |
| 318 | 0.0013 | 3.10 | 0.30 | 0.0021 | 0.0011 | 3.5 | | | 3.5 | — | — | — | 0.100 | Ca: 0.004, Ce: 0.004 | 2.90 |

TABLE 5-2

| No. | Item: Transformation Point: Ar3 Temperature [° C.] | Transformation Point: Ar1 Temperature [° C.] | Transformation Point: Ac1 Temperature [° C.] | Hot Rolling Step Finish Rolling Temperature FT [° C.] | Cooling Step: Time to Start Cooling sec | Cooling Step: Temperature After 3 Seconds [° C.] |
|---|---|---|---|---|---|---|
| 301 | 795 | 699 | 897 | 950 | 0.10 | 650 |
| 302 | 795 | 699 | 897 | 950 | 0.10 | 650 |
| 303 | 795 | 699 | 897 | 950 | 0.10 | 650 |
| 304 | 795 | 699 | 897 | 950 | 0.10 | 650 |
| 305 | 795 | 699 | 897 | 950 | 0.10 | 650 |
| 306 | 795 | 699 | 897 | 950 | 0.10 | 650 |
| 307 | | | | 950 | 0.10 | 650 |
| 308 | | | | 950 | 0.10 | 650 |
| 309 | | | | 950 | 0.10 | 650 |
| 310 | | | | 950 | 0.10 | 650 |
| 311 | 870 | 765 | 936 | 950 | 0.10 | 650 |
| 312 | 870 | 765 | 936 | 950 | 0.10 | 650 |
| 313 | 840 | 745 | 913 | 950 | 0.10 | 700 |
| 315 | 840 | 745 | 913 | 950 | 0.10 | 700 |
| 316 | 840 | 745 | 913 | 950 | 0.10 | 700 |
| 317 | 840 | 745 | 913 | 950 | 0.10 | 700 |
| 318 | 840 | 745 | 913 | 950 | 0.10 | 700 |

| No. | Item: After Hot Rolling Average Grain Size [μm] | Item: Cold Rolling Step Rolling Reduction RR1 [%] | Item: Intermediate annealing Step Annealing Temperature T1 [° C.] | Item: Skin Pass Rolling Step Rolling Reduction RR2 [%] | Item: Final Annealing Step Annealing Temperature T2 [° C.] | Evaluation |
|---|---|---|---|---|---|---|
| 301 | 5.5 | 86 | 700 | 0 | 800 | Comparative Example |
| 302 | 5.5 | 86 | 700 | 4 | 800 | Comparative Example |
| 303 | 5.5 | 86 | 700 | 6 | 800 | Inventive Example |
| 304 | 5.5 | 86 | 700 | 13 | 800 | Inventive Example |
| 305 | 5.5 | 86 | 700 | 18 | 800 | Inventive Example |
| 306 | 5.5 | 86 | 700 | 22 | 800 | Comparative Example |
| 307 | 12.8 | 86 | 700 | 0 | 800 | Comparative Example |
| 308 | 12.8 | 86 | 700 | 13 | 800 | Comparative Example |
| 309 | 11.5 | 86 | 700 | 0 | 800 | Comparative Example |
| 310 | 11.5 | 86 | 700 | 13 | 800 | Comparative Example |
| 311 | 5.2 | 86 | 700 | 0 | 800 | Comparative Example |
| 312 | 5.2 | 86 | 700 | 13 | 800 | Comparative Example |
| 313 | 5.0 | 86 | 700 | 15 | 800 | Inventive Example |
| 315 | 5.0 | 86 | 700 | 15 | 800 | Inventive Example |
| 316 | 5.0 | 86 | 700 | 15 | 800 | Inventive Example |
| 317 | 5.0 | 86 | 700 | 15 | 800 | Inventive Example |
| 318 | 5.0 | 86 | 700 | 15 | 800 | Inventive Example |

TABLE 6-1

| No. | Texture After Intermediate annealing α-Fiber Ratio $A_{\alpha\alpha}$ [%] | Texture After Skin Pass: α-Fiber Ratio $A_{s\alpha}$ [%] | Texture After Skin Pass: {100}<011> ODF Intensity [—] | Texture After Skin Pass: Gs [—] | Texture After Final Annealing: {411}<011> Ratio [%] | Texture After Final Annealing: φ1 at {411}<uvw> ODF max [°] | Texture After Final Annealing: Φ at {hkl}<011> ODF max [°] | Texture After Final Annealing: A411-011/A411-148 [—] | Texture After Final Annealing: A411-011/A100-011 [—] |
|---|---|---|---|---|---|---|---|---|---|
| 301 | 32.1 | 32.1 | 8.8 | 0.2 | 12.4 | 20 | 20 | 0.8 | 1.5 |
| 302 | 32.1 | 32.5 | 8.9 | 0.7 | 25.4 | 0 | 20 | 1.4 | 2.8 |
| 303 | 32.1 | 32.9 | 9.2 | 1.1 | 31.6 | 0 | 20 | 1.7 | 4.9 |
| 304 | 32.1 | 33.5 | 9.5 | 1.5 | 29.2 | 0 | 20 | 1.5 | 3.0 |
| 305 | 32.1 | 33.0 | 9.3 | 2.5 | 28.4 | 0 | 20 | 1.4 | 4.2 |
| 306 | 32.1 | 28.9 | 6.4 | 3.1 | 13.2 | 0 | 40 | 1.1 | 6.9 |
| 307 | 6.8 | 6.8 | 2.1 | 0.3 | 6.7 | 20 | 55 | 0.4 | 0.9 |
| 308 | 6.8 | 7.3 | 3.1 | 1.7 | 6.2 | 20 | 50 | 0.7 | 1.0 |
| 309 | 8.3 | 8.3 | 2.8 | 0.2 | 8.1 | 20 | 55 | 0.6 | 1.0 |
| 310 | 8.3 | 10.5 | 3.3 | 1.7 | 9.5 | 20 | 50 | 0.8 | 1.1 |
| 311 | 31.2 | 31.2 | 6.9 | 0.2 | 11.2 | 20 | 20 | 0.9 | 1.7 |
| 312 | 31.2 | 32.2 | 7.7 | 2.1 | 27.5 | 0 | 20 | 1.6 | 4.6 |
| 313 | 29.8 | 30.4 | 6.8 | 1.7 | 30.2 | 0 | 20 | 1.5 | 3.5 |
| 315 | 30.1 | 31.1 | 6.7 | 1.6 | 31.5 | 0 | 20 | 1.6 | 3.7 |
| 316 | 29.3 | 33.4 | 6.5 | 1.6 | 34.8 | 0 | 20 | 1.8 | 3.9 |
| 317 | 30.0 | 31.5 | 6.8 | 1.7 | 32.1 | 0 | 20 | 1.7 | 3.4 |
| 318 | 28.8 | 29.8 | 7.3 | 1.7 | 30.8 | 0 | 20 | 1.5 | 3.9 |

TABLE 6-2

| No. | Sheet Thickness [mm] | Microstructure Average Grain Size [μm] | Magnetic Characteristics: B50 (Whole Circumference) [T] | Magnetic Characteristics: B50 (45°) [T] | Magnetic Characteristics: W10/400 (45°) [W/kg] | Magnetic Characteristics: Iron Loss Deterioration Ratio $W_x$ [%] | Evaluation |
|---|---|---|---|---|---|---|---|
| 301 | 0.30 | 32.1 | 1.58 | 1.60 | 14.3 | 52.1 | Comparative Example |
| 302 | 0.30 | 44.5 | 1.60 | 1.68 | 14.1 | 33.4 | Comparative Example |
| 303 | 0.30 | 66.9 | 1.63 | 1.73 | 13.1 | 26.7 | Inventive Example |
| 304 | 0.30 | 69.2 | 1.64 | 1.75 | 13.1 | 32.7 | Inventive Example |
| 305 | 0.30 | 70.1 | 1.64 | 1.74 | 13.5 | 28.5 | Inventive Example |
| 306 | 0.30 | 71.7 | 1.57 | 1.63 | 14.4 | 33.5 | Comparative Example |
| 307 | 0.30 | 46.7 | 1.60 | 1.55 | 14.7 | 51.9 | Comparative Example |
| 308 | 0.30 | 66.7 | 1.58 | 1.54 | 15.0 | 50.7 | Comparative Example |
| 309 | 0.30 | 48.4 | 1.61 | 1.57 | 14.5 | 50.3 | Comparative Example |
| 310 | 0.30 | 59.7 | 1.61 | 1.59 | 14.5 | 49.1 | Comparative Example |
| 311 | 0.30 | 40.2 | 1.58 | 1.63 | 14.3 | 45.7 | Comparative Example |
| 312 | 0.30 | 71.1 | 1.67 | 1.74 | 15.4 | 30.1 | Comparative Example |
| 313 | 0.30 | 70.8 | 1.60 | 1.71 | 13.6 | 30.4 | Inventive Example |
| 315 | 0.30 | 73.1 | 1.61 | 1.72 | 13.3 | 29.8 | Inventive Example |
| 316 | 0.30 | 70.3 | 1.62 | 1.72 | 13.0 | 28.6 | Inventive Example |
| 317 | 0.30 | 75 | 1.61 | 1.71 | 13.5 | 30.1 | Inventive Example |
| 318 | 0.30 | 76.5 | 1.61 | 1.72 | 13.1 | 30.2 | Inventive Example |

Underlines in Table 5-1. Table 5-2. Table 6-1, and Table 6-2 indicate conditions deviating from the scope of the present invention.

Nos. 303 to 305 and 313 to 318 of Inventive Examples had good values for all of the magnetic flux density B50 in the 45° direction, the iron loss W10/400, and the iron loss deterioration ratio.

On the other hand, No. 301 of Comparative Example was manufactured by the same process as Nos. 303 to 305 of inventive steels until the intermediate annealing, and in a state before the skin pass, it was a cold-rolled steel sheet corresponding to Claim 7 which is an embodiment of the present invention, but was not subjected to the skin pass rolling. Therefore, No. 301 of Comparative Example had poor magnetic flux density B50 (45° direction), iron loss W10/400 (45° direction), and iron loss deterioration ratio. Similarly to No. 301 described above, No. 302 of Comparative Example was a cold-rolled steel sheet corresponding to Claim 7 which is an embodiment of the present invention in a state before the skin pass, but it had a very small rolling reduction RR2 in the skin pass rolling. Therefore, the obtained non-oriented electrical steel sheet had poor iron loss W10/400 (45° direction). Similarly to Nos. 301 and 302 described above, No. 306 of Comparative Example was a cold-rolled steel sheet corresponding to Claim 7 which is an embodiment of the present invention in a state before the skin pass rolling, but it had a very large rolling reduction RR2 in the skin pass. Therefore, the obtained non-oriented electrical steel sheet had poor magnetic flux density B50 (45° direction) and iron loss W10/400 (45° direction). Nos. 307 to 310 of Comparative Examples had poor magnetic flux density B50 (45° direction), iron loss W10/400 (45° direction), and iron loss deterioration ratio because they had a composition in which α-γ transformation does not occur. No. 311 of Comparative Example had poor magnetic flux density B50 (45° direction), iron loss W10/400 (45° direction), and iron loss deterioration ratio because Mn and the like (one or more of Mn, Cu, and Ni) was insufficient and the skin pass rolling was not performed. No. 312 of Comparative Example had poor iron loss W10/400 (45° direction) because Mn and the like was insufficient.

Example 4

A molten steel was cast to produce an ingot having a chemical composition shown in Table 7-1. Here, the left side of the equation represents a value on the left side in Equation (1). In addition, Mg and the like represents the total of one or more selected from the group consisting of Mg, Ca, Sr, Ba, Ce, La, Nd, Pr, Zn, and Cd. Thereafter, the produced ingot was heated to 1,150° C., hot-rolled, and finish-rolled at a finish rolling temperature FT shown in Table 7-2. Cooling was then performed under cooling conditions shown in Table 7-2 after the steel sheet has passed through the final pass (a time from when the steel sheet passes through the final pass in the finish rolling to when the cooling is started, and a temperature of the steel sheet 3 seconds later after the steel sheet has passed through the final pass).

Here, in order to examine the texture after the cooling, an average grain size was measured by the same procedure as in Example 1. The measurement results are shown in Table 7-2.

Next, the hot-rolled steel sheet was not annealed, and the scales were removed by pickling, and cold rolling was performed at a rolling reduction RR1 shown in Table 7-2. Then, intermediate annealing was performed to be held for 30 seconds by performing the intermediate annealing in the atmosphere containing 20% hydrogen and 80% nitrogen by a volume percentage and controlling the intermediate annealing temperature T1 to a temperature shown in Table 7-2.

Here, in order to examine the texture of the cold-rolled steel sheet before the skin pass rolling, an α-fiber ratio was obtained by the same procedure as in Example 1. The results are shown in Table 8-1.

Next, skin pass rolling was performed at a rolling reduction RR2 shown in Table 7-2.

Before the final annealing, in order to examine the texture after the skin pass rolling, an α-fiber ratio and Gs were obtained by the same procedure as in Example 1. Each result is shown in Table 8-1.

Next, the final annealing was performed at the final annealing temperature T2 shown in Table 7-2 in the atmosphere of 100% hydrogen. Here, a retention time at the final annealing temperature T2 was set to 2 hours.

In order to examine a texture after the final annealing, the {411}<011> ratio, the φ1 and Φ at maximum intensity, A411-011/A411-148, and A411-011/A100-011 are obtained in the same procedure as in Example 1. Each result is shown in Table 8-1.

Moreover, in order to examine the magnetic characteristics after the final annealing, a magnetic flux density B50 and an iron loss W10/400 were measured, and an iron loss deterioration ratio $W_x$ of the iron loss W10/50 under a compressive stress was obtained as an index of stress sensitivity. The measurement procedure is the same as that in Example 1. The measurement results are shown in Table 8-2.

TABLE 7-1

| | Item Chemical Composition (Remainder of Fe And Impurities) | | | | | | | | | | | | | | |
|---|---|---|---|---|---|---|---|---|---|---|---|---|---|---|---|
| No. | C [mass %] | Si [mass %] | sol. Al [mass %] | S [mass %] | N [mass %] | Mn [mass %] | Cu [mass %] | Ni [mass %] | Total of Mn, Cu, And Ni [mass %] | Co [mass %] | Sn [mass %] | Sb [mass %] | P [mass %] | Mg And The Like [mass %] | Left Side in Equation |
| 401 | 0.0013 | 3.10 | 0.30 | 0.0021 | 0.0011 | 3.5 | | | 3.5 | — | — | — | 0.100 | — | 2.90 |
| 402 | 0.0013 | 3.10 | 0.30 | 0.0021 | 0.0011 | 3.5 | | | 3.5 | — | — | — | 0.100 | — | 2.90 |
| 403 | 0.0013 | 3.10 | 0.30 | 0.0021 | 0.0011 | 3.5 | | | 3.5 | — | — | — | 0.100 | — | 2.90 |
| 404 | 0.0013 | 3.30 | 0.95 | 0.0021 | 0.0011 | 2.5 | | | 2.5 | — | — | — | 0.100 | — | −0.60 |
| 405 | 0.0013 | 3.30 | 0.95 | 0.0021 | 0.0011 | 2.5 | | | 2.5 | — | — | — | 0.100 | — | −0.60 |
| 406 | 0.0013 | 3.10 | 0.30 | 0.0021 | 0.0011 | 3.5 | | | 3.5 | — | — | — | 0.100 | — | 2.90 |
| 407 | 0.0013 | 3.10 | 0.30 | 0.0021 | 0.0011 | 3.5 | | | 3.5 | — | — | — | 0.100 | — | 2.90 |
| 408 | 0.0013 | 3.10 | 0.30 | 0.0021 | 0.0011 | 3.5 | | | 3.5 | — | — | — | 0.100 | — | 2.90 |

TABLE 7-1-continued

| No. | Item Chemical Composition (Remainder of Fe And Impurities) C [mass %] | Si [mass %] | sol. Al [mass %] | S [mass %] | N [mass %] | Mn [mass %] | Cu [mass %] | Ni [mass %] | Total of Mn, Cu, And Ni [mass %] | Co [mass %] | Sn [mass %] | Sb [mass %] | P [mass %] | Mg And The Like [mass %] | Left Side in Equation |
|---|---|---|---|---|---|---|---|---|---|---|---|---|---|---|---|
| 409 | 0.0013 | 3.10 | 0.30 | 0.0021 | 0.0011 | 3.5 | | | 3.5 | — | — | — | 0.100 | — | 2.90 |
| 410 | 0.0013 | 3.10 | 0.30 | 0.0021 | 0.0011 | 3.5 | | | 3.5 | — | — | — | 0.100 | — | 2.90 |
| 411 | 0.0013 | 3.10 | 0.30 | 0.0021 | 0.0011 | 3.5 | | | 3.5 | — | — | — | 0.100 | — | 2.90 |

TABLE 7-2

| No. | Item Transformation Point Ar3 Temperature [° C.] | Ar1 Temperature [° C.] | Ac1 Temperature [° C.] | Hot Rolling Step Finish Rolling Temperature FT [° C.] | Cooling Step Time to Start Cooling sec | Cooling Step Temperature After 3 Seconds [° C.] |
|---|---|---|---|---|---|---|
| 401 | 830 | 745 | 913 | 950 | 0.10 | 700 |
| 402 | 830 | 745 | 913 | 950 | 0.10 | 700 |
| 403 | 830 | 745 | 913 | 950 | 0.10 | 700 |
| 404 | — | — | — | 950 | 0.10 | 700 |
| 405 | — | — | — | 950 | 0.10 | 700 |
| 406 | 830 | 745 | 913 | 950 | 0.10 | 250 |
| 407 | 830 | 745 | 913 | 950 | 0.10 | 250 |
| 408 | 830 | 745 | 913 | 950 | 0.10 | 700 |
| 409 | 830 | 745 | 913 | 950 | 0.10 | 700 |
| 410 | 830 | 745 | 913 | 950 | 0.10 | 700 |
| 411 | 830 | 745 | 913 | 950 | 0.10 | 700 |

| No. | Item After Hot Rolling Average Grain Size [μm] | Cold Rolling Step Rolling Reduction RR1 [%] | Intermediate annealing Step Annealing Temperature T1 [° C.] | Skin Pass Rolling Step Rolling Reduction RR2 [%] | Final Annealing Step Annealing Temperature T2 [° C.] | Evaluation |
|---|---|---|---|---|---|---|
| 401 | 5.0 | 86 | 700 | 15 | 760 | Inventive Example |
| 402 | 5.0 | 86 | 700 | 15 | 880 | Inventive Example |
| 403 | 5.0 | 86 | 700 | 15 | 950 | Comparative Example |
| 404 | 15.3 | 86 | 700 | 15 | 760 | Comparative Example |
| 405 | 15.3 | 86 | 700 | 15 | 880 | Comparative Example |
| 406 | 4.2 | 86 | 700 | 15 | 760 | Comparative Example |
| 407 | 4.2 | 86 | 700 | 15 | 880 | Comparative Example |
| 408 | 5.0 | 86 | 700 | 25 | 700 | Comparative Example |
| 409 | 5.0 | 86 | 700 | 25 | 880 | Comparative Example |
| 410 | 5.0 | 86 | 700 | 15 | 800 | Inventive Example |
| 411 | 5.0 | 86 | 700 | 15 | 850 | Inventive Example |

TABLE 8-1

| No. | Texture After Intermediate annealing α-Fiber Ratio $A_{\alpha\alpha}$ [%] | Texture After Skin Pass: α-Fiber Ratio $A_{s\alpha}$ [%] | Texture After Skin Pass: {100}<011> ODF Intensity [—] | Texture After Skin Pass: Gs [—] | Texture After Final Annealing: {411}<011> Ratio [%] | Texture After Final Annealing: φ1 at {411}<011> ODF max [°] | Texture After Final Annealing: Φ at {hkl}<011> ODF max [°] | Texture After Final Annealing: A411-011/A411-148 [—] | Texture After Final Annealing: A411-011/A100-011 [—] |
|---|---|---|---|---|---|---|---|---|---|
| 401 | 29.8 | 30.4 | 7.4 | 2.1 | 27.8 | 0 | 20 | 1.5 | 3.0 |
| 402 | 29.8 | 30.4 | 11.2 | 2.1 | 41.7 | 0 | 20 | 2.0 | 6.4 |
| 403 | 29.8 | 30.4 | 6.5 | 2.1 | 10.2 | 0 | 20 | 1.1 | 2.1 |
| 404 | 12.9 | 14.2 | 2.2 | 2.3 | 8.2 | 20 | 55 | 0.5 | 1.0 |
| 405 | 12.9 | 14.2 | 2.3 | 2.3 | 7.8 | 20 | 55 | 0.4 | 0.9 |
| 406 | 32.1 | 31.5 | 18.7 | 2.1 | 13.4 | 0 | 0 | 1.3 | 0.9 |
| 407 | 32.1 | 31.5 | 20.3 | 2.1 | 12.2 | 0 | 0 | 1.2 | 0.7 |
| 408 | 29.8 | 30.9 | 1.4 | 4.1 | 14.1 | 0 | 30 | 1.1 | 3.4 |
| 409 | 29.8 | 30.9 | 1.2 | 4.1 | 12.3 | 0 | 30 | 1.2 | 4.7 |
| 410 | 29.8 | 30.4 | 7.3 | 2.1 | 30.4 | 0 | 20 | 1.8 | 5.1 |
| 411 | 29.8 | 30.4 | 7.1 | 2.1 | 35.6 | 0 | 20 | 2.0 | 5.8 |

TABLE 8-2

| No. | Sheet Thickness [mm] | Microstructure Average Grain Size [μm] | Magnetic Characteristics: B50 (Whole Circumference) [T] | Magnetic Characteristics: B50 (45°) [T] | Magnetic Characteristics: W10/400 (45°) [W/kg] | Magnetic Characteristics: Iron Loss Deterioration Ratio $W_x$ [%] | Evaluation |
|---|---|---|---|---|---|---|---|
| 401 | 0.30 | 54.2 | 1.58 | 1.70 | 13.4 | 29.9 | Inventive Example |
| 402 | 0.30 | 69.5 | 1.61 | 1.71 | 13.2 | 26.7 | Inventive Example |
| 403 | 0.30 | 33.2 | 1.51 | 1.48 | 16.2 | 34.8 | Comparative Example |
| 404 | 0.30 | 60.3 | 1.66 | 1.55 | 14.7 | 51.9 | Comparative Example |
| 405 | 0.30 | 61.2 | 1.63 | 1.54 | 14.8 | 52.7 | Comparative Example |
| 406 | 0.30 | 55.3 | 1.63 | 1.74 | 13.0 | 52.2 | Comparative Example |
| 407 | 0.30 | 80.7 | 1.63 | 1.73 | 13.3 | 53.8 | Comparative Example |
| 408 | 0.30 | 71.7 | 1.57 | 1.62 | 14.6 | 34.3 | Comparative Example |
| 409 | 0.30 | 75.8 | 1.59 | 1.63 | 14.3 | 33.7 | Comparative Example |
| 410 | 0.30 | 62.3 | 1.61 | 1.71 | 13.3 | 27.5 | Inventive Example |
| 411 | 0.30 | 68.5 | 1.61 | 1.71 | 13.2 | 26.4 | Inventive Example |

Underlines in Table 7-1, Table 7-2, Table 8-1, and Table 8-2 indicate conditions deviating from the scope of the present invention.

Nos. 401 and 402 of Inventive Examples had good values for all of the magnetic flux density B50 in the 45° direction, the iron loss W1/400, and the iron loss deterioration ratio.

On the other hand, No. 403 was manufactured by the same step as Nos. 401 and 402 of inventive steels until the skin pass rolling, and in a state before the final annealing, it satisfied an embodiment of the present invention (as a product, and as the manufacturing method), but was not final-annealed at a higher temperature than the Ac1 temperature. Therefore, the obtained non-oriented electrical steel sheet after the final annealing did not satisfy Claim 1 as a product having an average grain size of 50 μm or less. As a result, No. 403 had poor magnetic flux density B50 (45° direction) and the iron loss W10/400 (45° direction). Therefore, No. 403 is a Comparative Example. Nos. 404 and 405 of Comparative Examples had poor magnetic flux density B50 (45° direction), iron loss W10/400 (45° direction), and iron loss deterioration ratio because they had a composition in which α-γ transformation does not occur. Nos. 406 and 407 of Comparative Examples had large iron loss deterioration ratios under the compressive stress because of the rapid cooling after the finish rolling. Nos. 408 and 409 of Comparative Examples had poor magnetic flux density B50 (45° direction) and iron loss W10/400 (45° direction) because the rolling reduction RR2 in the skin pass rolling was very large.

What is claimed is:

1. A non-oriented electrical steel sheet comprising, as a chemical composition, by mass %:

C: 0.0100% or less;
Si: 1.50% to 4.00%;
sol.Al: 0.0001% to 1.00%;
S: 0.0100% or less;
N: 0.0100% or less;
one or more of Mn, Ni, and Cu: 2.5% to 5.0% in total;
Co: 0% to 1.0%;
Sn: 0% to 0.40%;
Sb: 0% to 0.40%;
P: 0% to 0.400%;
one or more of Mg, Ca, Sr, Ba, Ce, La, Nd, Pr, Zn, and Cd: 0% to 0.010% in total; and
a remainder of Fe and impurities,
wherein the following Equation (1) is satisfied, where, by mass %, a Mn content is [Mn], a Ni content is [Ni], a Cu content is [Cu], a Si content is [Si], a sol.Al content is [sol.Al], and a P content is [P],
in a case where Ahkl-uvw represents an area ratio of crystal grains in an {hkl}<uvw> orientation to an entire visual field when a plane at a depth of ½ of a sheet thickness from a surface parallel to a rolled surface is measured by SEM-EBSD (Scanning Electron Microscope-Electron Back Scattering Diffraction), A411-011 is 15.0% or more, and
an average grain size is 50 μm to 150 μm, $$(2\times[\mathrm{Mn}]+2.5\times[\mathrm{Ni}]+[\mathrm{Cu}])-([\mathrm{Si}]+2\times[sol.\mathrm{Al}]+4\times[\mathrm{P}])\geq 1.50\%. \quad (1)$$

2. The non-oriented electrical steel sheet according to claim 1, wherein when the surface is measured by the SEM-EBSD to create an ODF (Orientation Distribution Function) _at φ2=45°, the non-oriented electrical steel sheet has a maximum intensity at φ1=0° to 10° among φ1=0° to 90° and Φ=20°, and has a maximum intensity at Φ=5° to 35° among Φ1=0° and Φ=0° to 90°.

3. The non-oriented electrical steel sheet according to claim 1 or 2, wherein an area ratio of a specific orientation to the entire visual field when the plane at the depth of ½ of the sheet thickness from the surface parallel to the rolled surface is measured by the SEM-EBSD satisfies both the following Equations (2) and (3), $$A411-011/A411-148\geq 1.1 \quad (2)$$

$$A411-011/A100-011\geq 2.0. \quad (3)$$

4. A core comprising the non-oriented electrical steel sheet according to claim 3.

5. A cold-rolled steel sheet which is used for manufacturing the non-oriented electrical steel sheet according to claim 3, the cold-rolled steel sheet comprising, as a chemical composition, by mass %:

C: 0.0100% or less;
Si: 1.50% to 4.00%;
sol.Al: 0.0001% to 1.00%;
S: 0.0100% or less;
N: 0.0100% or less;
one or more of Mn, Ni, and Cu: 2.5% to 5.0% in total;
Co: 0% to 1.0%;
Sn: 0% to 0.40%;
Sb: 0% to 0.40%;
P: 0% to 0.400%;
one or more of Mg, Ca, Sr, Ba, Ce, La, Nd, Pr, Zn, and Cd: 0% to 0.010% in total; and
a remainder of Fe and impurities,
wherein the following Equation (1) is satisfied, where, by mass %, a Mn content is [Mn], a Ni content is [Ni], a Cu content is [Cu], a Si content is [Si], a sol.Al content is [sol.Al], and a P content is [P], and
an area ratio $A_{\alpha\alpha}$ of crystal grains having a crystal orientation of an a-fiber to an entire visual field when a plane at a depth of ½ of a sheet thickness from a surface parallel to a rolled surface is measured by SEM-EBSD is 15.0% or more, $$(2\times[\mathrm{Mn}]+2.5\times[\mathrm{Ni}]+[\mathrm{Cu}])-([\mathrm{Si}]+2\times[sol.\mathrm{Al}]+4\times[\mathrm{P}])\geq 1.50\%. \quad (1)$$

6. A core comprising the non-oriented electrical steel sheet according to claim 1 or 2.

7. A cold-rolled steel sheet which is used for manufacturing the non-oriented electrical steel sheet according to claim 1 or 2, the cold-rolled steel sheet comprising, as a chemical composition, by mass %:

C: 0.0100% or less;
Si: 1.50% to 4.00%;
sol.Al: 0.0001% to 1.00%;
S: 0.0100% or less;
N: 0.0100% or less;
one or more of Mn, Ni, and Cu: 2.5% to 5.0% in total;
Co: 0% to 1.0%;
Sn: 0% to 0.40%;
Sb: 0% to 0.40%;
P: 0% to 0.400%;
one or more of Mg, Ca, Sr, Ba, Ce, La, Nd, Pr, Zn, and Cd: 0% to 0.010% in total; and
a remainder of Fe and impurities,
wherein the following Equation (1) is satisfied, where, by mass %, a Mn content is [Mn], a Ni content is [Ni], a Cu content is [Cu], a Si content is [Si], a sol. Al content is [sol.Al], and a P content is [P], and
an area ratio $A_{\alpha\alpha}$ of crystal grains having a crystal orientation of an a-fiber to an entire visual field when a plane at a depth of ½ of a sheet thickness from a surface parallel to a rolled surface is measured by SEM-EBSD is 15.0% or more, $$(2\times[\mathrm{Mn}]+2.5\times[\mathrm{Ni}]+[\mathrm{Cu}])-([\mathrm{Si}]+2\times[sol.\mathrm{Al}]+4\times[\mathrm{P}])\geq 1.50\%. \quad (1)$$

8. A method for manufacturing a non-oriented electrical steel sheet according to claim 1, the method comprising:

a hot rolling step of performing hot rolling on a steel material so that a final pass of finish rolling is performed at an Ar3 temperature or higher to obtain a hot-rolled steel sheet, the steel material including, as a chemical composition, by mass%: C: 0.0100% or less, Si: 1.50% to 4.00%, sol.Al: 0.0001% to 1.00%, S: 0.0100% or less, N: 0.0100% or less, one or more of Mn, Ni, and Cu: 2.5% to 5.0% in total, Co: 0% to 1.0%, Sn: 0% to 0.40%, Sb: 0% to 0.40%, P: 0% to 0.400%, one or more of Mg, Ca, Sr, Ba, Ce, La, Nd, Pr, Zn, and Cd: 0% to 0.010% in total, and a remainder of Fe and impurities, in which the following Equation (1) is satisfied, where, by mass%, a Mn content is [Mn], a Ni content is [Ni], a Cu content is [Cu], a Si content is [Si], a sol.Al content is [sol.Al], and a P content is [P];

a cooling step of cooling the hot-rolled steel sheet after the hot rolling step;

a cold rolling step of performing cold rolling on the hot-rolled steel sheet after the cooling step to obtain a cold-rolled steel sheet;

an intermediate annealing step of performing intermediate annealing on the cold-rolled steel sheet;

a skin pass rolling step of performing skin pass rolling on the cold-rolled steel sheet after the intermediate annealing step to obtain the non-oriented electrical steel sheet; and a final annealing step of performing final annealing on the non-oriented electrical steel sheet after the skin pass rolling step at an annealing temperature of 750°C. or higher and an Ac1 temperature or lower and at an annealing time of 2 hours or longer, wherein in the cooling step, the cooling is started after 0.10 seconds or longer have elapsed from the final pass of the finish rolling, a temperature is set to 300°C. or higher and an Ar1 temperature or lower for transformation after 3 seconds, and a rolling reduction in the skin pass rolling step is 5% to 20%.

9. The method for manufacturing a non-oriented electrical steel sheet according to claim 8, wherein in the cooling step, an average grain size of the hot-rolled steel sheet after the cooling step is 3 to 10 μm.

10. The method for manufacturing a non-oriented electrical steel sheet according to claim 9, wherein a rolling reduction in the cold rolling step is 75% to 95%.

11. The method for manufacturing a non-oriented electrical steel sheet according to claim 10, wherein in the intermediate annealing step, an annealing temperature is set to the Ac1 temperature or lower.

12. The method for manufacturing a non-oriented electrical steel sheet according to claim 9, wherein in the intermediate annealing step, an annealing temperature is set to the Ac1 temperature or lower.

13. The method for manufacturing a non-oriented electrical steel sheet according to claim 8, wherein a rolling reduction in the cold rolling step is 75% to 95%.

14. The method for manufacturing a non-oriented electrical steel sheet according to claim 13, wherein in the intermediate annealing step, an annealing temperature is set to the Ac1 temperature or lower.

15. The method for manufacturing a non-oriented electrical steel sheet according to claim 8, wherein in the intermediate annealing step, an annealing temperature is set to the Ac1 temperature or lower.

* * * * *